US006333599B1

(12) United States Patent
Kawanami et al.

(10) Patent No.: US 6,333,599 B1
(45) Date of Patent: Dec. 25, 2001

(54) PLASMA DISPLAY SYSTEM

(75) Inventors: Yoshimi Kawanami, Kokubunji; Keizo Suzuki, Kodaira; Kenichi Yamamoto, Higashimurayama; Shirun Ho, Setagaya-ku; Masaji Ishigaki; Ryohei Satoh, both of Yokohama; Masayuki Shibata, Hitachi; Tomohiko Murase, Kawasaki; Michifumi Kawai, Minato-ku, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/232,666

(22) Filed: Jan. 19, 1999

(30) Foreign Application Priority Data

Jan. 21, 1998 (JP) ..... 10-009283

(51) Int. Cl.[7] ..... H01J 17/49
(52) U.S. Cl. ..... 313/582; 315/169.4; 345/60
(58) Field of Search ..... 313/581–604, 313/609; 315/349, 169.4, 169.1; 345/60–72

(56) References Cited

U.S. PATENT DOCUMENTS

| | | | | |
|---|---|---|---|---|
| 4,190,788 | * | 2/1980 | Yoshikawa et al. | 315/169.4 |
| 5,066,890 | * | 11/1991 | Salavin et al. | 313/585 |
| 5,661,500 | * | 8/1997 | Shinoda et al. | 345/60 |
| 5,742,122 | * | 4/1998 | Amemiya et al. | 313/582 |
| 5,877,734 | * | 3/1999 | Amemia | 345/60 |
| 5,889,365 | * | 3/1999 | Tanabe | 313/582 |
| 5,900,694 | * | 5/1999 | Matsuzaki et al. | 313/484 |
| 5,969,478 | * | 10/1999 | Shino et al. | 315/169.4 |
| 5,995,069 | * | 11/1999 | Tokunaga et al. | 345/60 |
| 6,037,916 | * | 3/2000 | Amemiya | 345/60 |
| 6,072,449 | * | 6/2000 | Amemiya | 345/67 |
| 6,084,559 | * | 7/2000 | Nagao et al. | 345/67 |
| 6,088,011 | * | 7/2000 | Lee et al. | 345/60 |
| 6,118,214 | * | 9/2000 | Marcotte | 313/582 |
| 6,150,766 | * | 11/2000 | Shino et al. | 315/169.4 |
| 6,157,354 | * | 12/2000 | Amemiya | 345/60 |
| 6,195,070 | * | 2/2001 | Shinoda et al. | 345/60 |

FOREIGN PATENT DOCUMENTS

| | | |
|---|---|---|
| 3-187125 | 8/1991 | (JP) . |
| 7-262930 | 10/1995 | (JP) . |
| 8-22772 | 1/1996 | (JP) . |
| 8-315734 | 11/1996 | (JP) . |

* cited by examiner

*Primary Examiner*—Michael H. Day
*Assistant Examiner*—Matthew J. Gerike
(74) *Attorney, Agent, or Firm*—Mattingly, Stanger & Malur, P.C.

(57) ABSTRACT

A plasma display system has a plasma display panel including a pair of base plates for forming a plurality of discharge cells therebetween, and a plurality of pairs of electrodes for sustaining discharge to form plasma through a dielectric substance thereon in the discharge cells. The pairs of electrodes for sustaining discharge are disposed on a same one of the pair of base plates. The plasma display panel is configured such that a discharge current integrated over 40% of a discharge time Td from a start of the discharge time Td is smaller than a discharge current integrated over a remainder of the discharge time Td in one discharge, wherein the discharge time Td is defined as a time interval over which a discharge current does not drop to less than 5% of its maximum value in one discharge.

20 Claims, 18 Drawing Sheets

PLASMA DISPLAY SYSTEM

BACKGROUND OF THE INVENTION

The present invention relates to a plasma display system employing a plasma display panel (hereinafter referred to as "PDP").

In recent years, a plasma display system employing an AC surface-discharge PDP is expected as a promising large-sized, thin-profile color display system. The structure of the AC surface-discharge PDP will be described below. Most of the PDPs of this type are of a three-electrode structure. Two base plates, a front glass base plate and a rear glass base plate, are arranged opposite to each other with a specific gap put therebetween. A plurality of pairs of line electrodes are formed on the inner surface (opposite to the rear glass base plate) serving as a display screen, of the front glass base plate. The line electrodes are covered with a dielectric substance. A plurality of column electrodes coated with phosphor are formed on the rear glass base plate. The column electrodes may be covered with a dielectric substance. The intersection portion of one pair of the line electrodes and one column electrode, as seen from the display screen side, constitutes one discharge cell. A space between both the base plates is filled with a discharge gas (typically, a mixed gas of two kinds or more of He, Ne, Xe, Ar and the like). The discharge gas causes discharge when a voltage pulse is applied between the electrodes, and ultraviolet light generated from the excited discharge gas is converted into visible light by the phosphor. For the color display, a set of three kinds of cells generally form one pixel. The line electrodes which perform sustaining of discharge for main light emission, are called the electrodes for sustaining discharge.

The realization of a large-sized display by employing such a PDP increases the amount of a current to be supplied to the electrodes, giving rise to a problem in increasing the power consumption. To reduce the power consumption, it is effective to improve the efficiency of luminescence during discharge in the PDP.

When dimensions of each cell are reduced to increase definition of the display image, that is, to increase the number of pixels, a loss in energy for producing plasma is increased, which causes a problem of lowering the efficiency of luminescence.

Techniques for improving the efficiency of luminescence are already known. For example, Japanese Patent Laid-open Nos. Hei 8-22772 and Hei 3-187125 disclose a technique in which the size and shape of each electrode for sustaining discharge are designed to improve the efficiency of luminescence. Japanese Patent Laid-open Nos. Hei 7-262930 and Hei 8-315734 disclose a technique in which the material of a dielectric substance covering each electrode for sustaining discharge is designed to improve the efficiency of luminescence.

SUMMARY OF THE INVENTION

The above-described prior art techniques for improving the efficiency of luminescence in the AC surface-discharge PDP did not take into account time variation of the efficiency of luminescence in a discharge period of time.

The present invention has been made on the discovery of time variation of the efficiency of luminescence in which a time of the maximum efficiency of luminescence lags behind a time of the maximum discharge current in the prior art PDP, and accordingly, an object of the present invention is to provide a plasma display system employing a plasma display panel in which the discharge current before the time at which the maximum discharge current appears in the prior art PDP is reduced for making the time variation of the discharge current conform to the time variation of the efficiency of luminescence.

The features of the present invention to achieve the above object are as follows:

(1) A plasma display system having a plasma display panel comprising a pair of base plates for forming a plurality of discharge cells therebetween, and a plurality of pairs of electrodes for sustaining discharge to form plasma through a dielectric substance thereon in the plurality of discharge cells, the plurality of pairs of electrodes for sustaining discharge being disposed on a same one of the pair of base plates, wherein the plasma display panel is configured such that a discharge current integrated over 40% of a discharge time Td from a start of the discharge time Td is smaller than a discharge current integrated over a remainder of the discharge time Td in one discharge, the discharge time Td being defined as a time interval over which a discharge current does not drop to less than 5% of its maximum value in one discharge.

(2) A plasma display system having a plasma display panel comprising a pair of base plates for forming a plurality of discharge cells therebetween, and a plurality of pairs of electrodes for sustaining discharge to form plasma through a dielectric substance thereon in the plurality of discharge cells, the plurality of pairs of electrodes for sustaining discharge being disposed on a same one of the pair of base plates, wherein the plasma display panel is configured such that a discharge current and an efficiency of luminescence become maximum, respectively, after 40% of a discharge time Td from a start of the discharge time Td, the discharge time Td being defined as a time interval over which a discharge current does not drop to less than 5% of its maximum value in one discharge.

(3) A plasma display system having a plasma display panel comprising a pair of base plates for forming a plurality of discharge cells therebetween, and a plurality of pairs of electrodes for sustaining discharge to form plasma through a dielectric substance thereon in the plurality of discharge cells, the plurality of pairs of electrodes for sustaining discharge being disposed on a same one of the pair of base plates, wherein, assuming that in each of the pair of electrodes for sustaining discharge, a portion which extends from an end of the electrode on a discharge gap side thereof in a direction where the electrode is opposed to the other one of said pair of electrodes and which has a length equivalent to two-thirds of the width of the electrode is taken as a primary part and the remaining portion is taken as a secondary part, a portion of at least one of the pair of electrodes, positioned in each discharge cell, is specified such that a ratio of an area of the primary part to an area of the secondary part is smaller than 1.4 and a side surface of the secondary part in a direction perpendicular to the direction in which the pair of electrodes are opposed to each other is close to a boundary between said discharge cells.

(4) A plasma display system described in (3), wherein the ratio of the area of the primary part to the area of the secondary part is smaller than 1.

(5) A plasma display system having a plasma display panel in which pairs of electrodes for sustaining discharge to form plasma through a dielectric substance in a plurality of discharge cells each of which at least has a separation wall in one direction are provided on a same base plate, wherein, assuming that in each of the pair of electrodes for sustaining discharge, a portion which extends from an end of the electrode on a discharge gap side thereof in a direction where the electrode is opposed to the other one of the pair of electrodes and which has a length equivalent to two-thirds of the width of the electrode is taken as a primary part and the remaining portion is taken as a secondary part, a portion of at least one of the pair of electrodes, positioned in each discharge cell, is specified such that a ratio of an area of the primary part to an area of the secondary part is smaller than 1.4 and a side surface of the secondary part in a direction perpendicular to the direction in which the pair of electrodes are opposed to each other is close to the separation wall.

(6) A plasma display system described in (5), wherein the ratio of the area of the primary part to the area of the secondary part is smaller than 1.

(7) A plasma display system described in (5), wherein a partial separation wall is provided between adjacent ones of the discharge cells in the direction where the pair of electrodes for sustaining discharge are opposed to each other.

(8) A plasma display system described in (5), wherein the width of the electrode for sustaining discharge is in a range of 50 to 300 $\mu$m.

(9) A plasma display system described in (5), wherein the primary part has at least one or more of projections for each discharge cell.

(10) A plasma display system described in (5), wherein the primary part is perforated for each discharge cell.

(11) A plasma display system described in (5), wherein a side surface of a portion of the primary part extending from the boundary with the secondary part in each discharge cell is close to the boundary or the separation wall of the discharge cell; at least a portion of the secondary part has a stacked structure of a transparent electrode and an opaque electrode; and the remaining portion, other than the stacked structure, of the electrode for sustaining discharge, is formed of a transparent electrode.

(12) A plasma display system described in (5), wherein a side surface of a portion of the primary part extending from a boundary with the secondary part in each discharge cell is close to the boundary or the separation wall of the discharge cell; and the total of widths of the portion of the primary part and the secondary part in the direction where the pair of electrodes for sustaining discharge are opposed to each other is in a range of one-third or two-thirds of the width of the electrode for sustaining discharge.

(13) A plasma display system having a plasma display panel in which pairs of electrodes for sustaining discharge to form plasma through a dielectric substance in a plurality of discharge cells are provided on a same base plate, wherein, assuming that in each of said pair of electrodes for sustaining discharge, a portion which extends from an end of the electrode on a discharge gap side thereof in a direction where the electrode is opposed to the other one of the pair of electrodes and which has a length equivalent to two-thirds of the width of the electrode is taken as a primary part and the remaining portion is taken as a secondary part, a portion of at least one of the pair of electrodes, positioned in each discharge cell, is specified such that a ratio of a first capacitance between the primary part and a first dielectric substance opposed to the primary part in a discharge space of said discharge cell to a second capacitance between the secondary part and a second dielectric substance opposed to the secondary part in the discharge space of said discharge cell is smaller than 1.4.

(14) A plasma display system described in (13), wherein the ratio of the first capacitance to the second capacitance is smaller than 1.

(15) A plasma display system having a plasma display panel in which pairs of electrodes for sustaining discharge to form plasma through a dielectric substance in a plurality of discharge cells each of which at least has a separation wall in one direction are provided on a same base plate, wherein, assuming that in each of the pair of electrodes for sustaining discharge, a portion which extends from an end of the electrode on a discharge gap side thereof in a direction where the electrode is opposed to the other one of the pair of electrodes and which has a length equivalent to two-thirds of the width of the electrode is taken as a primary part and the remaining portion is taken as a secondary part, a portion of at least one of the pair of electrodes, positioned in each discharge cell, is specified such that a ratio of a first capacitance between the primary part and a first dielectric substance opposed to the primary part in a discharge space of the discharge cell to a second capacitance between said secondary part and a second dielectric substance opposed to the secondary part in the discharge space of said discharge cell is smaller than 1.4.

(16) A plasma display system described in (15), wherein the ratio of the first capacitance to the second capacitance is smaller than 1.

a (17) A plasma display system described in (15), wherein a partial separation wall is provided between adjacent ones of the discharge cells in a direction where the pair of electrodes for sustaining discharge are opposed to each other.

(18) A plasma display system described in (15), an average dielectric constant of the first dielectric substance for storing the first capacitance in cooperation of the primary part is smaller than an average dielectric constant of the second dielectric substance for storing the second capacitance in cooperation of the secondary part.

(19) A plasma display system described in (15), wherein a side surface of a portion of the primary part extending from the boundary with the secondary part in each discharge cell is close to the boundary or the separation wall of the discharge cell; at least a portion of the secondary part has a stacked structure of a transparent electrode and an opaque electrode; the remaining portion, other than said stacked structure, of said electrode for sustaining discharge, is formed of a transparent electrode; and an average dielectric constant of a third dielectric substance opposed to the stacked structure portion in a discharge space of the discharge cell is larger than the average dielectric constant of the first dielectric substance for storing the first capacitance in cooperation of the primary part.

(20) A plasma display system described in (15), wherein the width of the electrode for sustaining discharge is in a range of 50 to 300 $\mu$m.

BRIEF DESCRIPTION OF THE DRAWINGS

In the accompanying drawings, in which like reference numerals designate similar components throughout the figures, and in which.

DETAILED DESCRIPTION OF THE PREFERRED EMBODIMENTS

First, there will be described details how the present inventors found out such time variation of the efficiency of luminescence that a time of the maximum efficiency of luminescence lags behind a time of the maximum discharge current in a prior art AC surface-discharge PDP.

Figure 2:
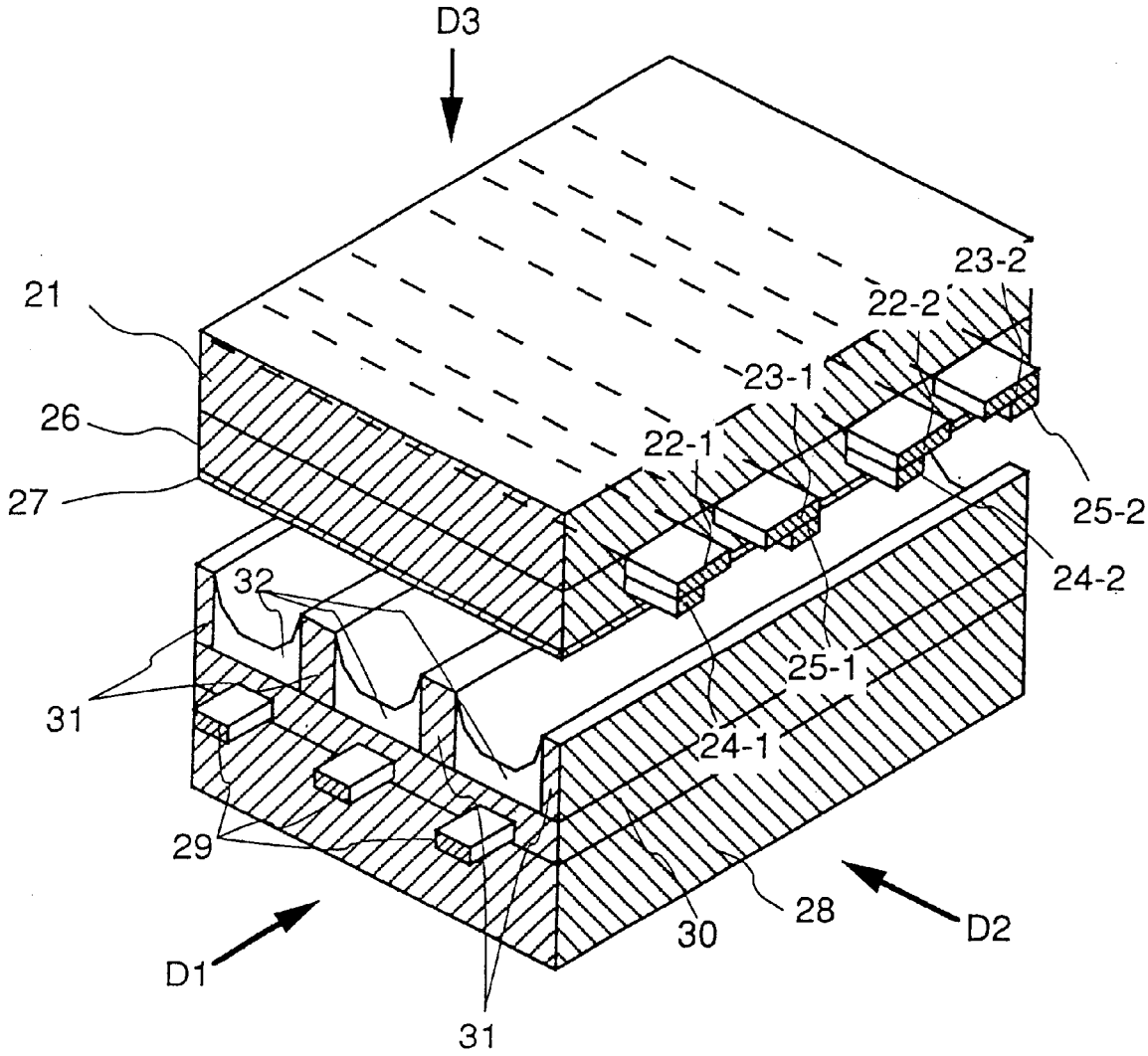
FIG. 2 PRIOR ART
FIG. 2 is a partial perspective view of an AC surface-discharge PDP having a three-electrode structure.

FIG. 2 shows an AC surface-discharge PDP having a three-electrode structure. A plurality of transparent common electrodes (two electrodes 22-1 and 22-2 are shown in FIG. 2) and a plurality of transparent independent electrodes (two electrodes 23-1 and 23-2 are shown in FIG. 2) are provided on the back face of a front glass base plate 21. Hereinafter, the common electrode is referred to as an "X-electrode" and the independent electrode is referred to as a "Y-electrode". The X-electrode and Y-electrode comprise a pair of electrodes for sustaining discharge. A plurality of opaque X-bus electrodes (two electrodes 24-1 and 24-2 are shown in FIG. 2) and a plurality of opaque Y-bus electrodes (two electrodes 25-1 and 25-2 are shown in FIG. 2) are stacked on the X-electrodes and Y-electrodes, respectively. The X-electrodes, Y-electrodes, X-bus electrodes, and Y-bus electrodes are covered with a dielectric substance 26 which is in turn covered with a protective layer 27 made from magnesium oxide (MgO) or the like.

A plurality of electrodes 29 (hereinafter referred to as "A-electrodes") are provided on the top face of a rear glass base plate 28 in such a manner as to three-dimensionally intersect the X-electrodes 22-1 and 22-2 and Y-electrodes 23-1 and 23-2 at right angles. The A-electrodes 29 are covered with a dielectric substance 30 on which a plurality of separation walls 31 are provided in such a manner as to be each positioned between the adjacent ones of the A-electrodes 29. A recessed region formed by wall surfaces of the adjacent separation walls 31 and the top face of the dielectric substrate 30 is coated with phosphor 32. In this configuration, an intersection between the pair of electrodes for sustaining discharge and the A-electrode corresponds to one discharge cell. These discharge cells are two-dimensionally arranged.

The width of the electrode for sustaining discharge is generally in a range of 50 to 300 $\mu$m.

Figure 3:
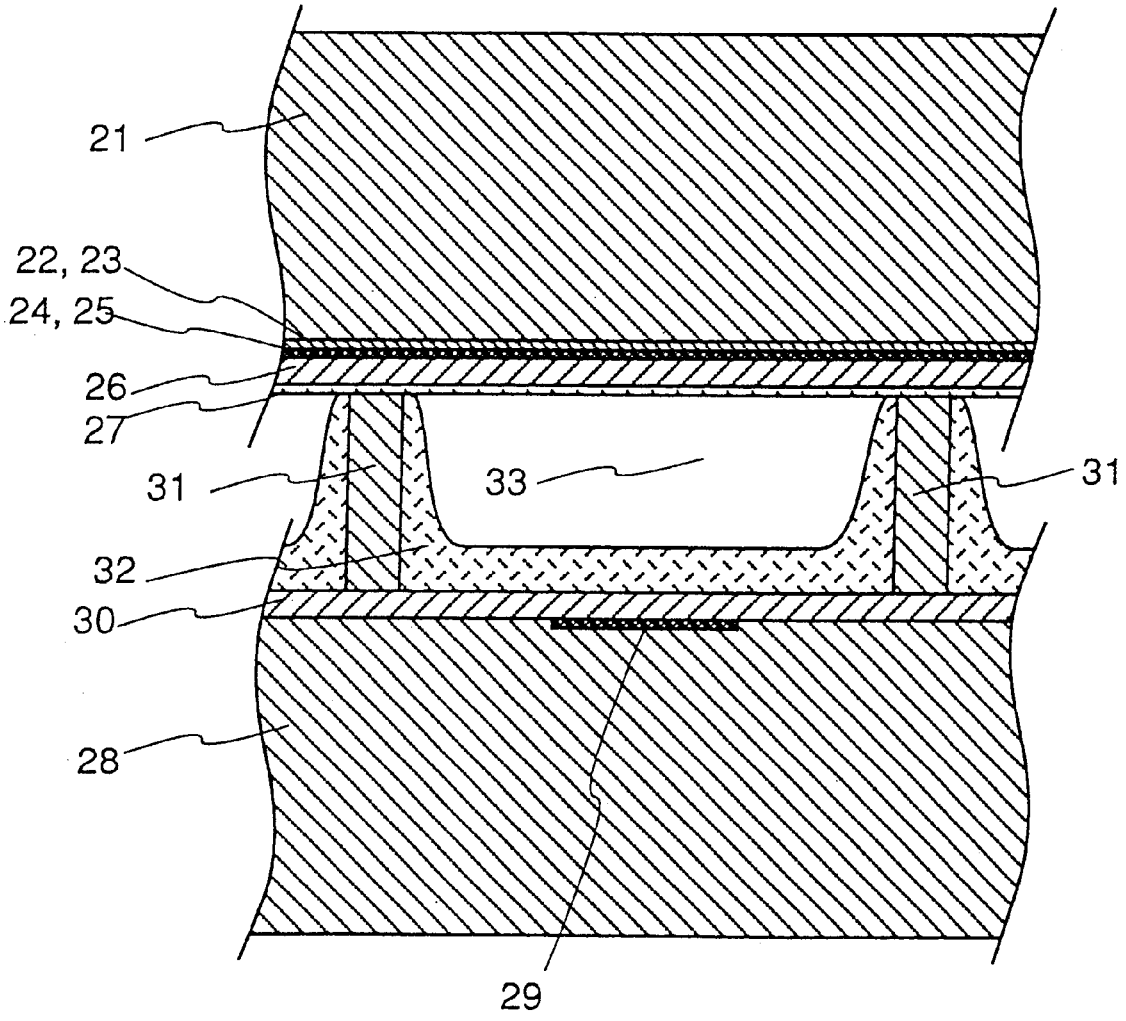
FIG. 3 PRIOR ART
FIG. 3 is a sectional view of a prior art PDP, seen in the direction equivalent to the direction shown by the arrow D1 in FIG. 2.

FIG. 3 is a sectional view, seen in the direction shown by the arrow D1 in FIG. 2, showing one discharge cell in the prior art AC surface-discharge PDP having the three-electrode structure. A discharge space 33 is filled with a gas for generating plasma. While the discharge space 33 is spatially partitioned from the adjacent one by the separation wall 31, the discharge space 33 may be spatially continued to the adjacent one via a gap formed between the separation wall 31 and a surface, on the discharge space side, of the front glass base plate 21.

Figure 4:
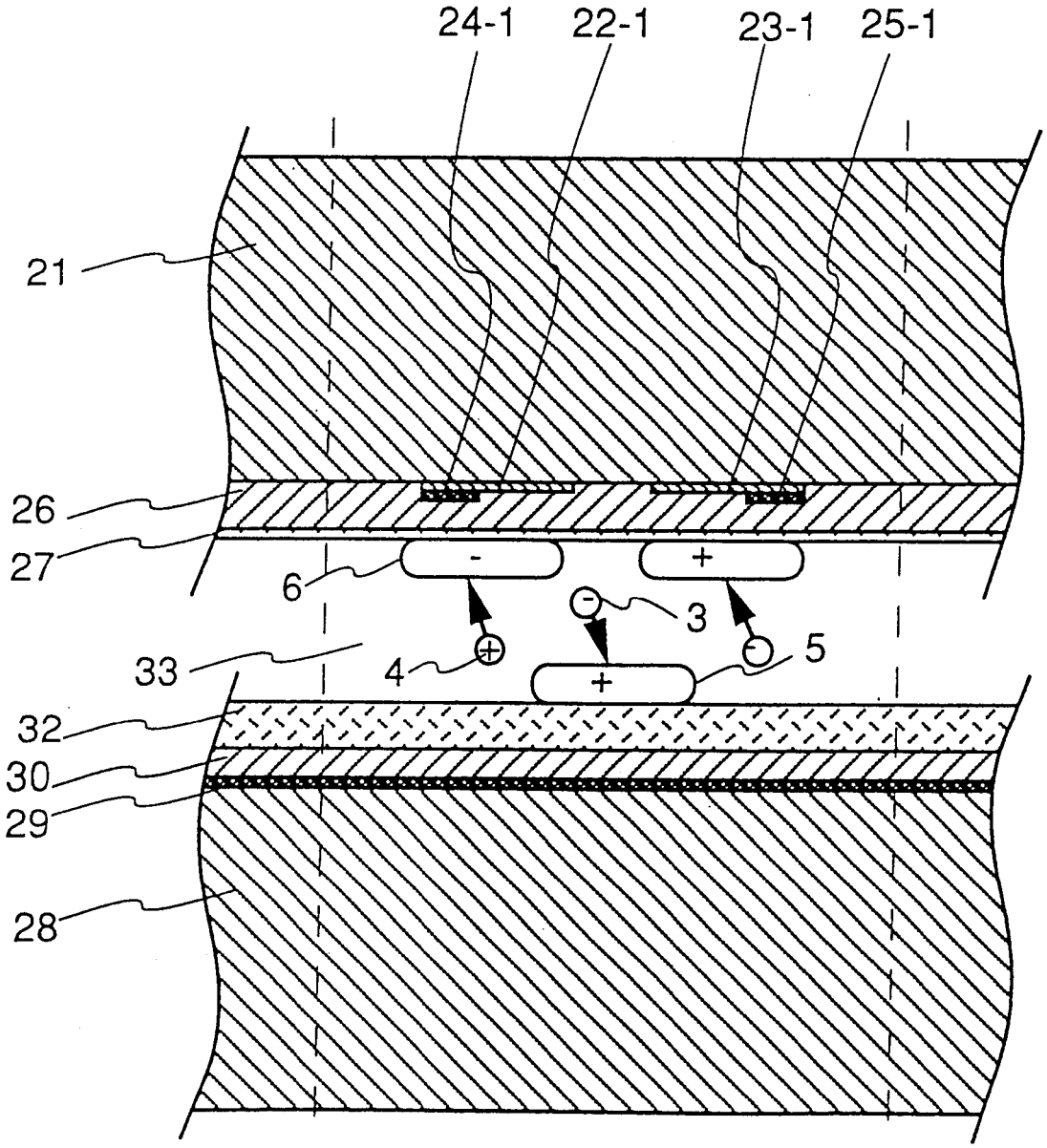
FIG. 4 PRIOR ART
FIG. 4 is a sectional view of the prior art PDP, seen in the direction equivalent to the direction shown by the arrow D2 in FIG. 2.

FIG. 4 is a sectional view, seen in the direction shown by the arrow D2 in FIG. 2, showing one discharge cell in the prior art AC surface-discharge PDP having the three-electrode structure. The boundary between the adjacent ones of the cells is schematically designated by the broken line. When respective positive voltages are applied to the A-electrode 29 and the Y-electrode 23-1 and a negative voltage is applied to the X-electrode 22-1 and in such a state a suitable voltage is repeatedly reversely applied between the Y-electrode 23-1 and the X-electrode 22-1, discharge occurs in the discharge space between the Y-electrode 23-1 and the X-electrode 22-1 via the dielectric substance 26 (and the protective layer 27). Reference numeral 3 designates electrons, 4 is positive ions, 5 is positive wall-charges, and 6 is negative wall-charges.

Figure 5:
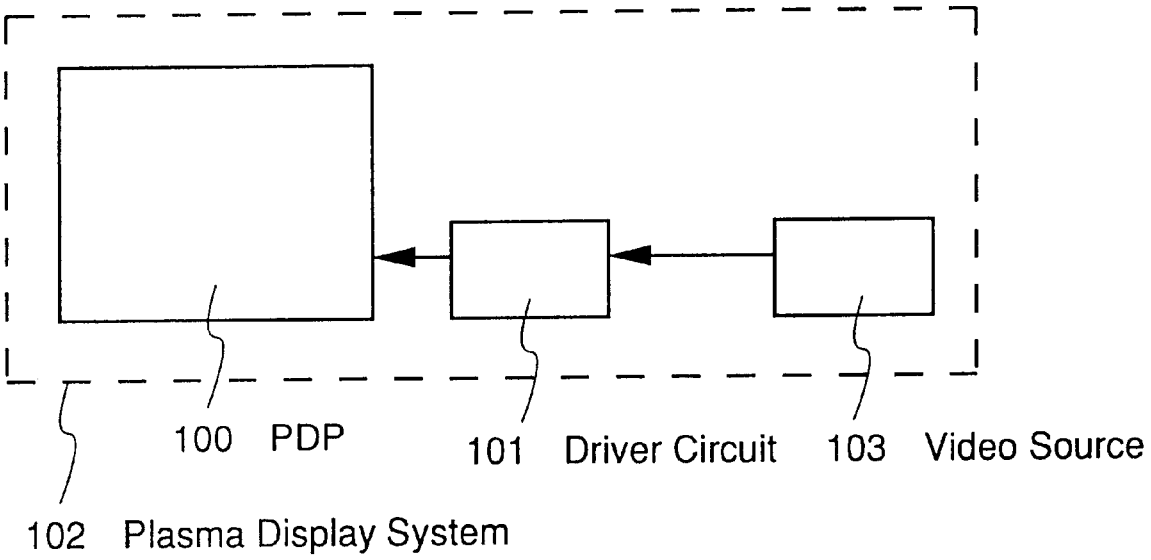
FIG. 5 is a block diagram of a plasma display system.
Figure 6:
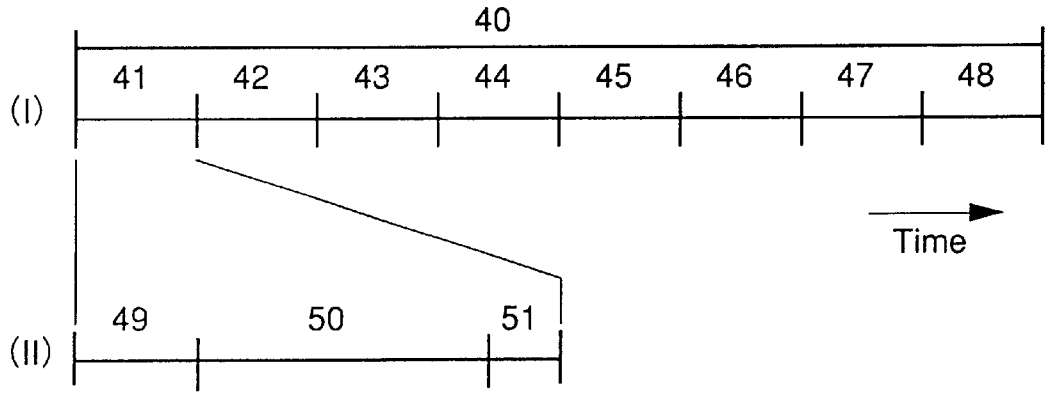
FIG. 6(A) is a diagram showing operation of a drive circuit in one TV-field period of time for making a single picture on the PDP.
FIG. 6(B) is a diagram showing voltage waveforms applied to an A-electrode, an X-electrode and a Y-electrode in a period of addressing emissive cells within the one TV-field period of time.
FIG. 6(C) is a diagram showing voltage pulses applied to the X-electrode and Y electrode in a period of light emission within the one TV-field period of time.
Figure 6:
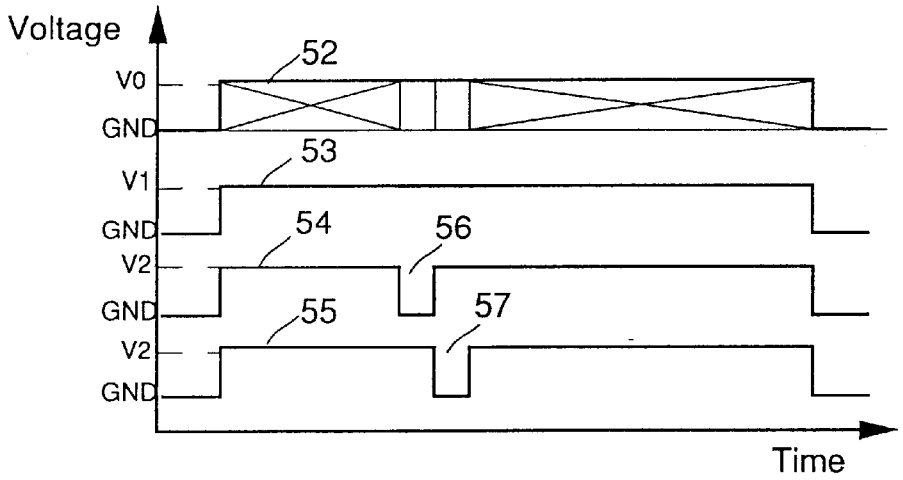
Figure 6:
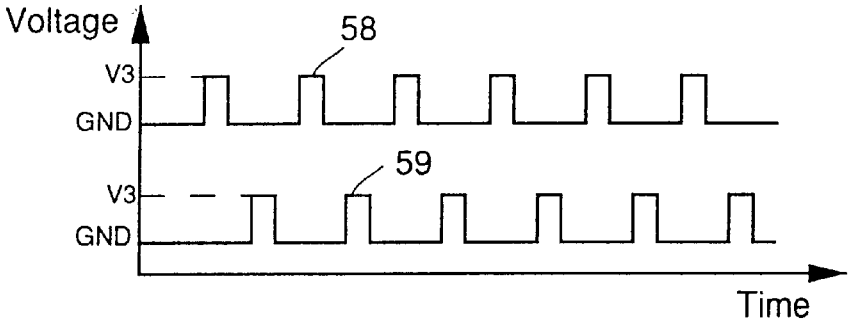

FIG. 5 shows a block diagram of a plasma display system 102 in which the above PDP designated by reference numeral 100 is assembled. In this plasma display system 102, a driver circuit 101 receives a signal for making a picture image from a video source 103, converting the signal into drive voltages shown in FIGS. 6A to 6C, and supplying the drive voltages to respective electrodes of the PDP 100. FIG. 6(A) shows a time chart of drive voltages in one TV-field period of time required to make a single picture on the PDP shown in FIG. 2. As shown in (I) of FIG. 6(A), the one TV-field period of time 40 is divided into sub-fields 41 to 48 having a plurality of different numbers of occurrences of light emission. The gradation of a picture image is expressed by selecting either light emission or non-light emission for each sub-field. As shown in (II) of FIG. 6(A), each sub-field includes a period 49 of resetting wall-charges, a period 50 of addressing emissive cells, and a period 51 of light emission.

FIG. 6(B) shows voltage waveforms which are applied to the A-electrode, X-electrode and Y-electrode respectively in the period 50 of addressing emissive cells shown in FIG. 6(A). Reference numeral 52 designates a voltage waveform (voltage: V0 volt) applied to one A-electrode in the period 50; 53 is a voltage waveform (voltage: V1 volt) applied to the X-electrode in the period 50; and 54 and 55 are voltage waveforms (voltage: V2 volt) applied to the i-th Y-electrode and the (i+1)-th Y-electrode, respectively in the period 50. As shown in FIG. 6(B), when a scanning pulse 56 is applied to the i-th Y-electrode, the cell positioned at the intersection between the i-th Y-electrode and the A-electrode 29 applied with the voltage of V0 is addressed as the emissive cell therebetween; while the cell positioned at the intersection between the i-th Y-electrode and the A-electrode 29 at the ground potential is not addressed as an emissive cell. At the cell addressed as the emissive cell, charges generated by applying the effective voltage are stored on the surfaces of the dielectric substance and the protective layer which cover the Y-electrode. These charges determine ON/OFF of sustaining discharge.

FIG. 6(C) shows voltage pulses simultaneously applied to the X-electrode and Y-electrode which constitute the pair of electrodes for sustaining discharge in the period 51 of light emission shown in FIG. 6(A). A voltage waveform 58 is applied to the X-electrode and a voltage waveform 59 is applied to the Y-electrode. This means that the voltage pulse of V3 (V) is alternately applied to the X-electrode and the Y-electrode, that is, reversion of polarity of the voltage between the X-electrode and the Y-electrode is repeated. At this time, sustaining discharge occurs between the X-electrode and Y-electrode at the discharge cell addressed as the emissive cell.

Figure 7:
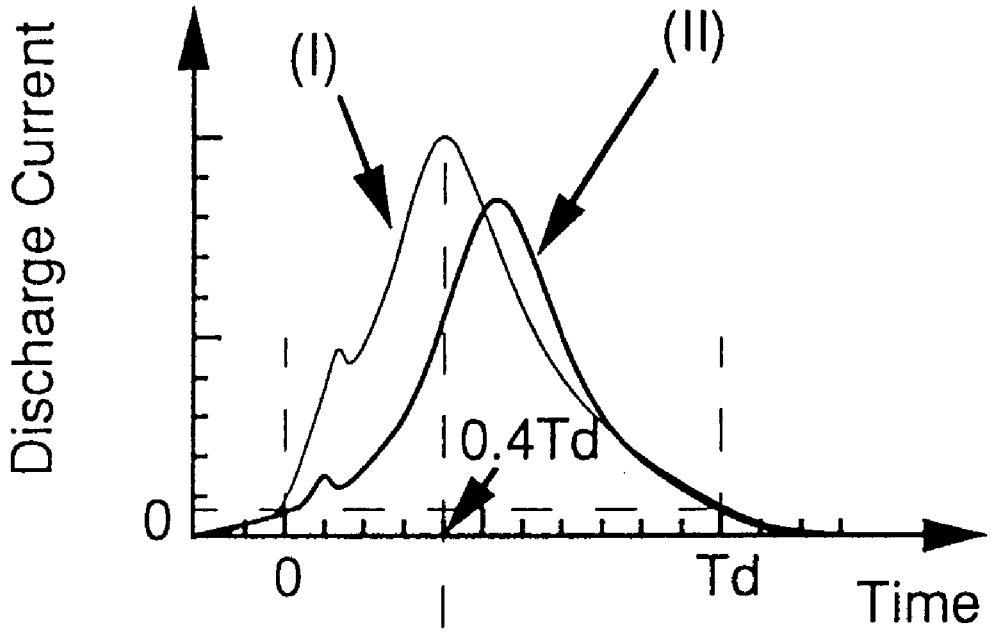
FIG. 7(A) is a graph showing time variation of a discharge current flowing through one cell of the PDP according to the first embodiment.
FIG. 7(B) is a graph showing time variation of the efficiency of luminescence during the discharge.
Figure 7:
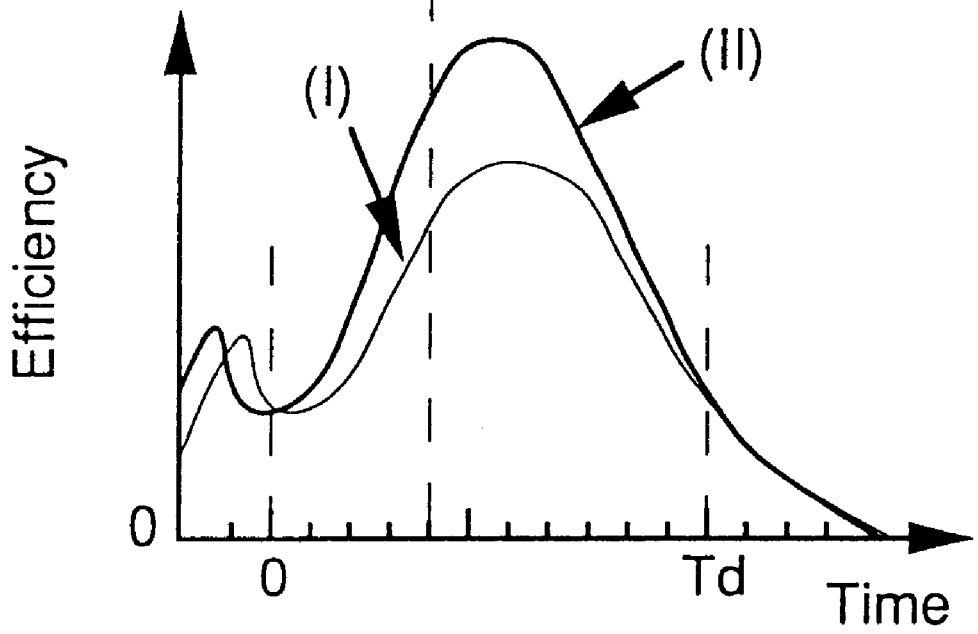

Next, time variation of a discharge current generated during one sustaining discharge between the pair of electrodes for sustaining discharge positioned in one discharge cell of the PDP and time variation of the efficiency of luminescence during the discharge are shown in the graph (I) in FIG. 7(A) and the graph (II) of FIG. 7(B), respectively. As is apparent from comparison between the two graphs, a time of the maximum efficiency of luminescence lags behind a time of the maximum discharge current, and further the efficiency of luminescence is relatively low in the front half of the discharge period.

On the basis of the difference in time variation between the discharge current and the efficiency of luminescence, the present inventor made smaller, as shown by the curve (II) of FIG. 7(A), the discharge current before the time of the maximum discharge current than that in the prior art shown by the curve (I) of FIG. 7(A) so as to make the time variation of the discharge current conform to the time variation of the efficiency of luminescence, and hence to improve the efficiency of luminescence.

Hereinafter, the present invention will be described in detail with reference to embodiments.

Embodiment 1

Figure 1:
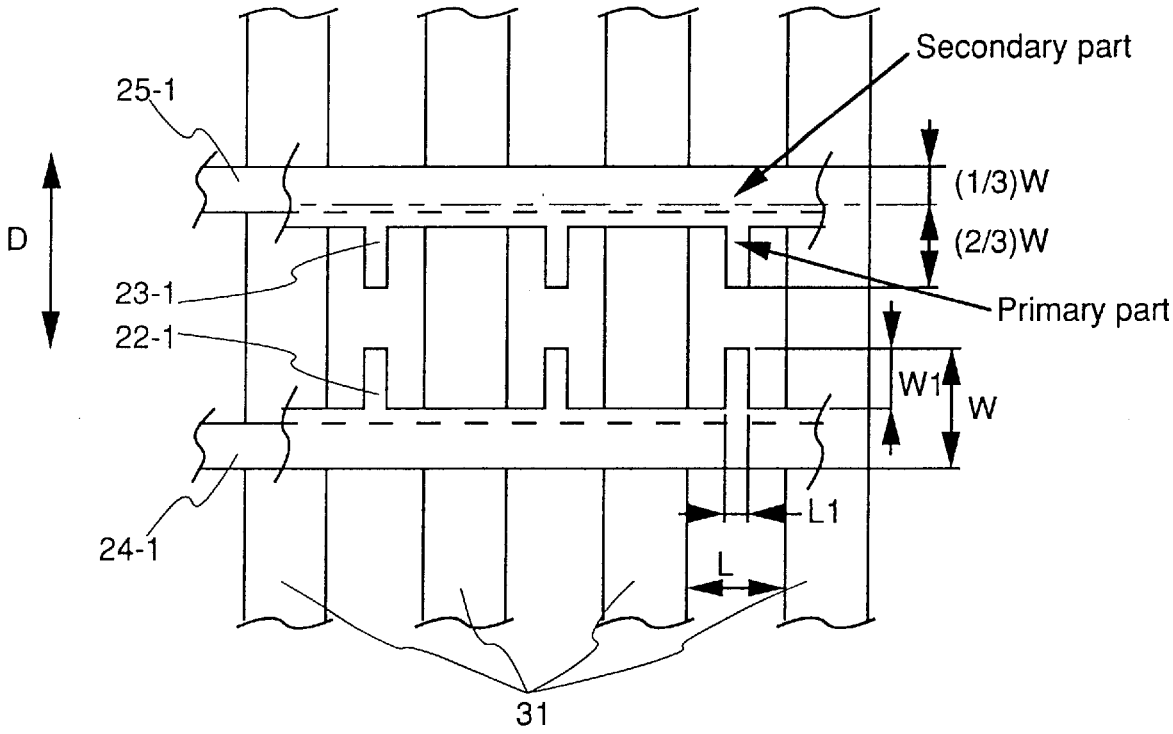
FIG. 1 is a top view, seen from the display screen side, showing the structure of a PDP according to a first embodiment of the present invention.

FIG. 1 is a top view, seen in the direction shown by the arrow D3 in FIG. 2, showing the structure of a PDP according to a first embodiment of the present invention. In this figure, the width of electrodes for sustaining discharge is measured in a direction designated by the arrow D. This embodiment is characterized in that as shown in FIG. 1, in each of the pair of electrodes for sustaining discharge, that is, a transparent X-electrode 22-1 and a transparent Y-electrode 23-1, a portion having two-thirds of the width of the electrode on a discharge gap (inner gap between the pair of electrodes for sustaining discharge) side is partially cut off for each discharge cell into a shape having a projection. The PDP is an XGA panel of 25 inches in diagonal length, in which the width W of each of the electrodes for sustaining discharge is 110 $\mu$m, the length L of the discharge space between the separation walls 31 is 90 $\mu$m, and the discharge gap between the X-electrode 22-1 and Y-electrode 23-1 is 60 $\mu$m. Here, the cutoff depth W1 of the electrode for sustaining discharge is 55 $\mu$m and the thickness L1 of the projection is 20 $\mu$m.

Time variation of the discharge current generated during one sustaining discharge between the pair of electrodes for sustaining discharge in one discharge cell of the PDP is shown in FIG. 7(A), and time variation of the (instantaneous) efficiency of luminescence during the discharge is shown in FIG. 7(B). In each of FIG. 7(A) and FIG. 7(B), the graph (1) shows the data obtained from the prior art PDP with no change in shape of the electrode for sustaining discharge, and the graph (II) shows the data obtained from the PDP in this embodiment. As is apparent from comparison between FIGS. 7(A) and 7(B), the efficiency of luminescence is relatively low in the front half of the discharge period of time. To be more specific, let a discharge time Td be a time interval over which a discharge current does not drop to less than 5% of its maximum value, in the case of the prior art PDP, the maximum discharge current appears about 40% of the discharge time Td after the start of the discharge time Td and the maximum efficiency of luminescence appears later at a time of about 60% of the time Td after the start of the time Td. The present inventors have found that, to improve the efficiency of luminescence throughout discharge (a value obtained by dividing the overall light emission by the overall input power), it is required to make the time at which the maximum discharge current appears close to the time at which the maximum the efficiency of luminescence appears, that is, to reduce the discharge current during the front half of the discharge time Td during which the efficiency of luminescence is relatively low. Here, it is known that sustaining discharge begins from the discharge gap side, proceeding to gradually shift the central position of the discharge intensity to the outside of the pair of electrodes for sustaining discharge while accumulating wall charges due to the discharge current on the dielectric substance covering the electrode for sustaining discharge, and terminates when the electric field in the discharge space is canceled by the wall charges. On the basis of the above knowledge, the present inventors thought that there is some relationship between time of discharge and a location of discharge, and accordingly, to reduce the discharge current in the front half of the discharge time Td, it is effective to reduce the area of the electrodes and hence to reduce the capacitance therebetween for sustaining discharge on the discharge gap side.

Figure 8:
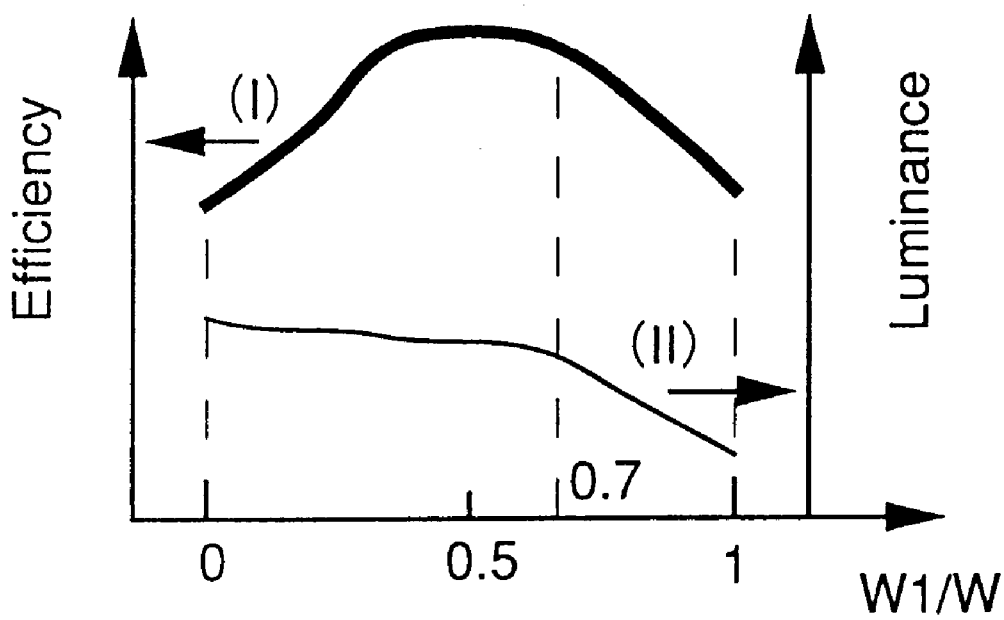
FIG. 8 is a graph showing dependencies of the efficiency of luminescence throughout discharge and the luminescence on a ratio of a width of an area-reduced portion of a primary part of the electrode to the width of the electrode.

The dependencies of the efficiency of luminescence during charge and the luminescence (value obtained by dividing the overall light emission by one discharge period of time) on a width ratio W1/W are shown by a graph (I) and a graph (II) in FIG. 8, respectively. In addition, W is the width of the electrode for sustaining discharge, and W1 is the width of the portion of the electrode for sustaining discharge, which portion is cut off from the discharge gap side into the projecting shape having the specific thickness in this embodiment. As shown in FIG. 8, the efficiency of luminescence is maximized when the width ratio W1/W is in a range of about ⅓ to ⅔ (in this range, the change in efficiency of luminescence is small, and more specifically, the efficiency of luminescence is maximized at the width ratio W1/W of about ½). On the other hand, the luminescence only a little changed when the width ratio W1/W is in a range of 0 to about ⅔, but it is abruptly reduced when the width ratio W1/W exceeds a value of ⅔. On the basis of the data, it is estimated that in the region on the discharge gap side, of the electrode for sustaining discharge, which region has two-thirds of the width of the electrode, the efficiency of luminescence becomes lower at a position closer to the discharge gap side; while in the region on the opposed side to the discharge gap, of the electrode for sustaining discharge, which region has one-third of the width of the electrode, the efficiency of luminescence is very high and is substantially kept constant. Accordingly, it becomes apparent that assuming that the former region is defined as a primary part of the electrode for sustaining discharge and the latter region is defined as a secondary part of the electrode for sustaining discharge, the efficiency of luminescence can be improved by reducing the electrode area of the primary part. In particular, it may be desired that the width ratio W1/W (W1: the width of the portion whose area is reduced) in the primary part be in a range of ⅓ to ½. This makes it possible to minimize the reduction in luminescence and to maximize the effect of improving the efficiency of luminescence. In this case, the remaining portion, whose area is not reduced, of the primary part of the electrode for sustaining discharge is generally configured as a transparent electrode portion, to thereby ensure a high opening ratio.

In this embodiment, as shown in the graph (II) of FIG. 7(A), the discharge current (that is, discharge charges) in the front half of the discharge time Td is reduced to about one-third of that in the prior art shown in the graph (I) in FIG. 7(A), and the time at which the maximum discharge current appears is retarded close to the time at which the maximum efficiency of luminescence appears. In this embodiment, as shown in the graph (II) in FIG. 7(B), the maximum efficiency of luminescence is enhanced as compared with that in the prior art shown in the graph (I) in FIG. 7(B). With these results, it is estimated that a change in distribution of the efficiency of luminescence for each discharging location is larger than a change in time of the efficiency of luminescence during discharge. Consequently, in this embodiment, there is obtained an effect of improving the efficiency of luminescence throughout discharge by about 50%.

As the area of the primary part of the electrode for sustaining discharge becomes smaller, the primary part becomes more effective to improve the efficiency of luminescence; however, since the primary part is a portion for determining the initial voltage for generating discharge, the area of the primary part cannot be set at zero. Also, as a result of an experimental examination, it may be desired that the area of the primary part of the electrode for sustaining discharge be smaller than 1.4 times the area of the secondary part to significantly improve the efficiency of luminescence.

As is apparent from the configuration shown in FIG. 1, a capacitance (C1) per unit width of the primary part is smaller than a capacitance (C2) of the secondary part. As an experimental examination, it may be desired that the ratio C1/C2 be in a range of ½ or less, and for this purpose, it may be desired that the ratio L1/L be in a range of ½ or less.

Figure 9:
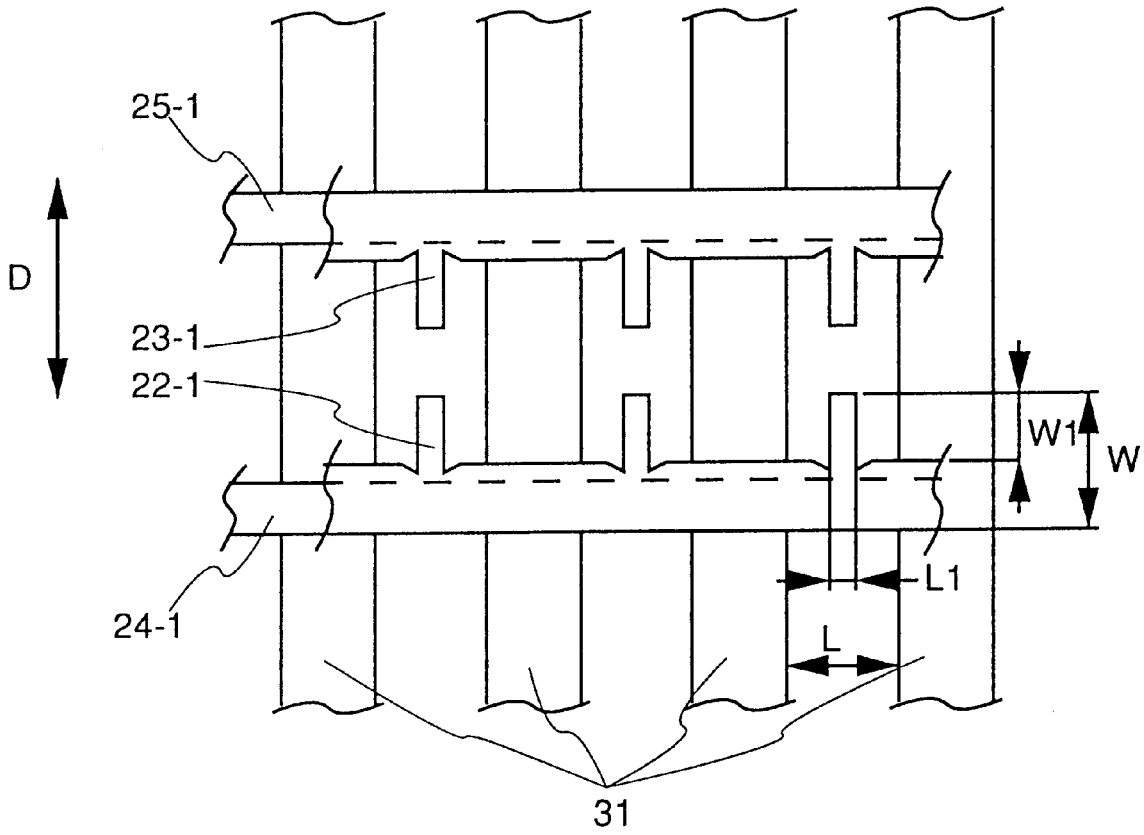
FIG. 9 is a top view, seen from the display screen side, showing another structure of the PDP according to the first embodiment of the present invention.

Incidentally, although the electrode area per unit width of the projection of the primary part of the electrode for sustaining discharge in the PDP of this embodiment is reduced to about one-fourth of that in the prior art PDP, the discharge current in the PDP of this embodiment is reduced to about one-third of that in the prior art PDP as shown in FIG. 7(A). The reason for this will be described below. The electric field generated from the electrode for sustaining discharge leaks into a space filled with the discharge gas via a layer of the dielectric substance having the thickness of 25 $\mu$m. As a result, the apparent electrode area having influence on electrons and ions generated in the discharge gas upon discharge becomes slightly broader than the actual electrode area. Such a phenomenon occurs significantly at the root portion of the projecting electrode. To be more specific, the apparent electrode area of the root portion of the projecting electrode is broadened by about 12 $\mu$m. That is to say, at such a portion, since the actual capacitance becomes larger than a value proportional to the electrode area, the reduction in discharge current becomes smaller. Here, it should be understood that the feature of the present invention is to make the capacitance of the primary part of the electrode for sustaining discharge relatively smaller than the capacitance of the secondary part. In this regard, it becomes often effective to slightly cut off only the root portion of the projection as shown in FIG. 9. Additionally, while the thickness L1 of the root portion of the projecting electrode may be desired to be as small as possible without deviation from the dimensional allowance required for the manufacturing process, care should be taken not to cause disconnection at the root portion in service.

In this embodiment, by adjusting a voltage pulse value applied between the pair of electrodes for sustaining discharge in a specific low range, it is possible to limit an electrode region for generating discharge only to the primary part (projecting electrode region in this embodiment), and hence to lower the luminescence. As a result, although the gradation of a picture image is generally changed by adjusting the number of sustaining discharge pulses for light emission of the cell addressed as the emissive cell, it can be more finely adjusted, in accordance with this embodiment, by changing the voltage pulse value for sustaining discharge.

Embodiment 2

Figure 10:
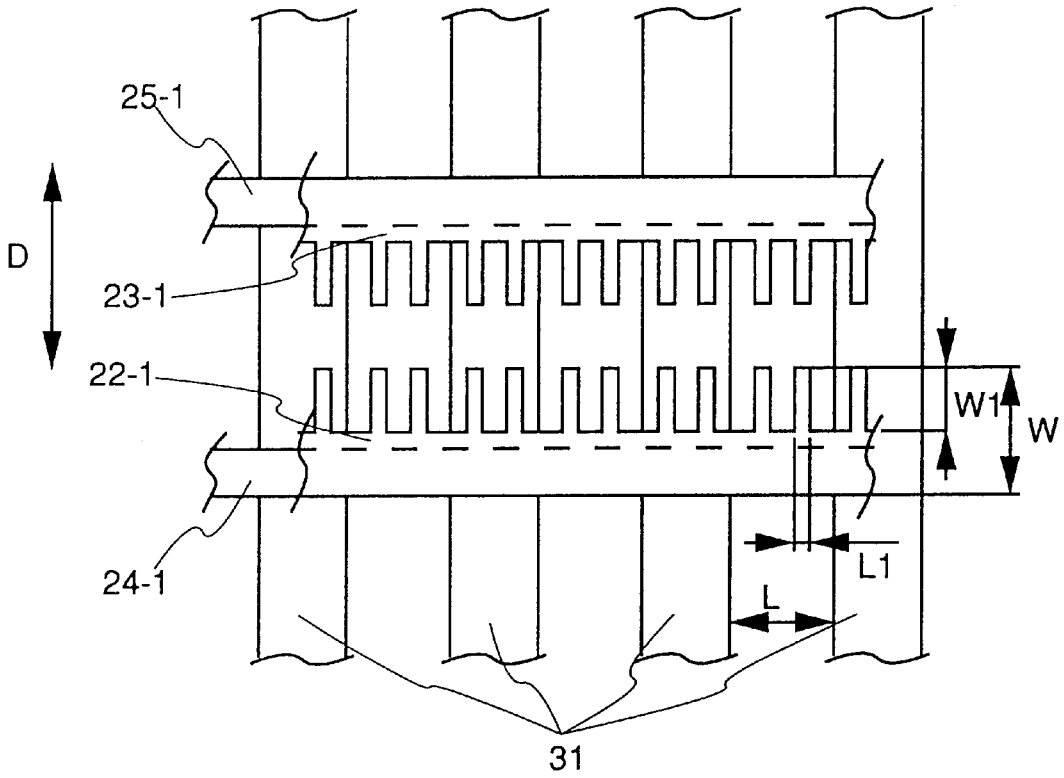
FIG. 10 is a top view, seen from the display screen side, showing the structure of a PDP according to a second embodiment of the present invention.

FIG. 10 is a top view, seen in the same direction as that shown in FIG. 1, showing the structure of a PDP according to a second embodiment of the present invention. This embodiment is characterized in that in each of the pair of electrodes for sustaining discharge, that is, the transparent X-electrode 22-1 and Y-electrode 23-1, the primary part is partially cut off for each discharge cell into a shape having a plurality (two pieces in FIG. 10) of projections.

In the first embodiment shown in FIG. 1, if the positioning accuracy between the front glass base plate and the rear glass base plate of the PDP is low, there may occur an inconvenience that the projection of the electrode for sustaining discharge is offset to be partially overlapped to the separation wall 31. In this case, the electrode area per unit width of the primary part is slightly increased, to reduce the degree of improving the efficiency of luminescence. On the other hand, in the case where a plurality of the projections are provided in one cell as in the embodiment shown in FIG. 10, even if the front glass base plate is offset from the rear glass base plate and thereby one projection is overlapped to the separation wall 31, another projection is placed over the discharge space, with a result that the electrode area of the primary part is little changed. That is to say, the degree of improving the efficiency of luminescence is stabilized against the above positioning between both the base plates. Accordingly, in the embodiment shown in FIG. 10, there is obtained an effect of increasing a margin in positioning between the front glass base plate and the rear glass base plate.

Embodiment 3

Figure 11:
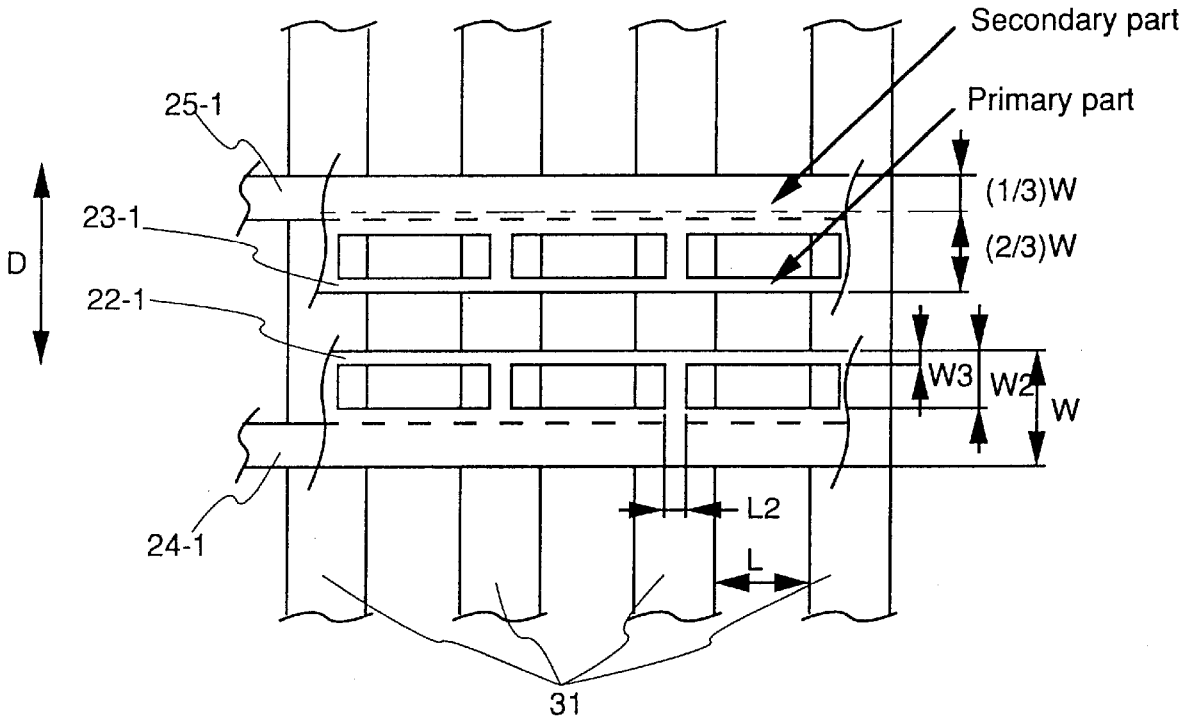
FIG. 11 is a top view, seen from the display screen side, showing the structure of a PDP according to a third embodiment of the present invention.

FIG. 11 is a top view, seen in the same direction as that shown in FIG. 1, showing the structure of a PDP according to a third embodiment of the present invention. This embodiment is characterized in that in each of the pair of electrodes for sustaining discharge, that is, the X-electrode 22-1 and the Y-electrode 23-1, the primary part is partially cutoff for each discharge cell into a perforated shape with a narrow band area remaining on the discharge gap side. The PDP is an XGA panel of 25 inches in diagonal length, in which the width W of each electrode for sustaining discharge is 110 $\mu$m, the length L of the discharge space between the separation walls 31 is 90 $\mu$m, and the discharge gap is 60 $\mu$m. Here, the cutoff depth W2 of the electrode for sustaining discharge is 60 $\mu$m and the width W3 of the band-like electrode portion remaining on the discharge gap side is 5 $\mu$m. The band-like electrode portion, positioned on the discharge gap side, of the electrode for sustaining discharge is connected to the secondary part of the electrode for sustaining discharge at a position over the separation wall 31 being irrelevant to discharge. The thickness L2 of the connecting portion is 20 $\mu$m. Accordingly, the electrode area per unit width of the primary part is about one-tenth of that of the secondary part. However, as described in the first embodiment, the apparent electrode area, effective to electrons and ions, of the primary part is not reduced to about one-tenth of the electrode area of the secondary part because the electric field is broadened via the dielectric substance.

Figure 12:
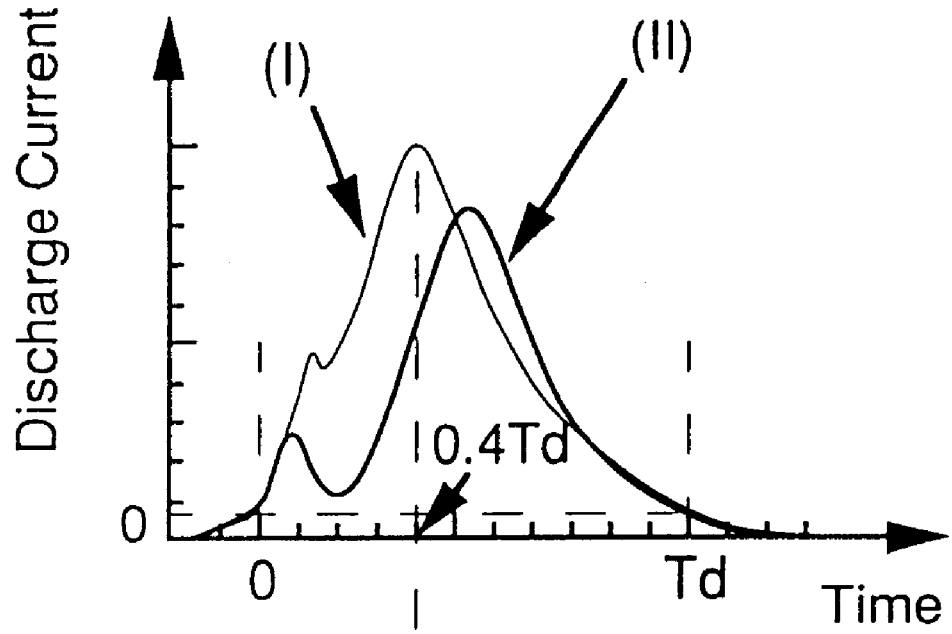
FIG. 12(A) is a graph showing time variation of the discharge current in the third embodiment and FIG. 12(B) is a graph showing time variation of the efficiency of luminescence in the third embodiment.
Figure 12:
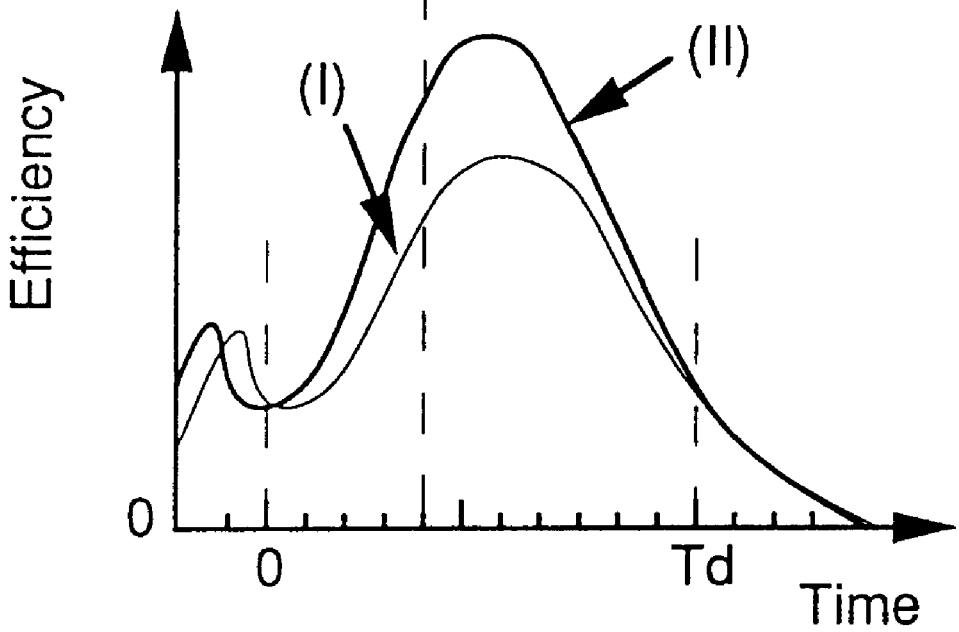

FIG. 12(A) shows the measured time variation of the discharge current during discharge between the pair of electrodes for sustaining discharge of this PDP, and FIG. 12(B) shows the measured time variation of the efficiency of luminescence during the discharge. In FIG. 12(A), a graph (I) shows the data obtained from the prior art PDP with no change in shape of the electrode for sustaining discharge, and a graph (II) shows the data obtained from the PDP in this embodiment. As is apparent from comparison between FIG. 12(A) and FIG. 12(B), the efficiency of luminescence is relatively low in the front half of the discharge time Td. Such a front half of the discharge time Td corresponds to the primary part of the electrode for sustaining discharge. As shown by the graph (II) in FIG. 12(A), for the PDP in this embodiment, the discharge current is reduced to about one-fifth of that for the prior art PDP with no change of shape of the electrode shown by the graph (I) in FIG. 12(A), in the front half of the discharge time Td in which the efficiency of luminescence is low. As a result, in this embodiment, there is obtained an effect of improving the efficiency of luminescence throughout discharge by about 60%.

In this embodiment, the portion, positioned on the discharge gap side, of the electrode for sustaining discharge is formed into the continuous band-like shape, and accordingly, even if the accuracy in positioning between the front glass base plate and the rear glass base plate of the PDP is low somewhat, the relatively positional relationship between the A-electrode and the electrode for sustaining discharge is not changed. This is effective to prevent occurrence of a failure in addressing emissive cells between the A-electrode and Y-electrode.

Embodiment 4

Figure 13:
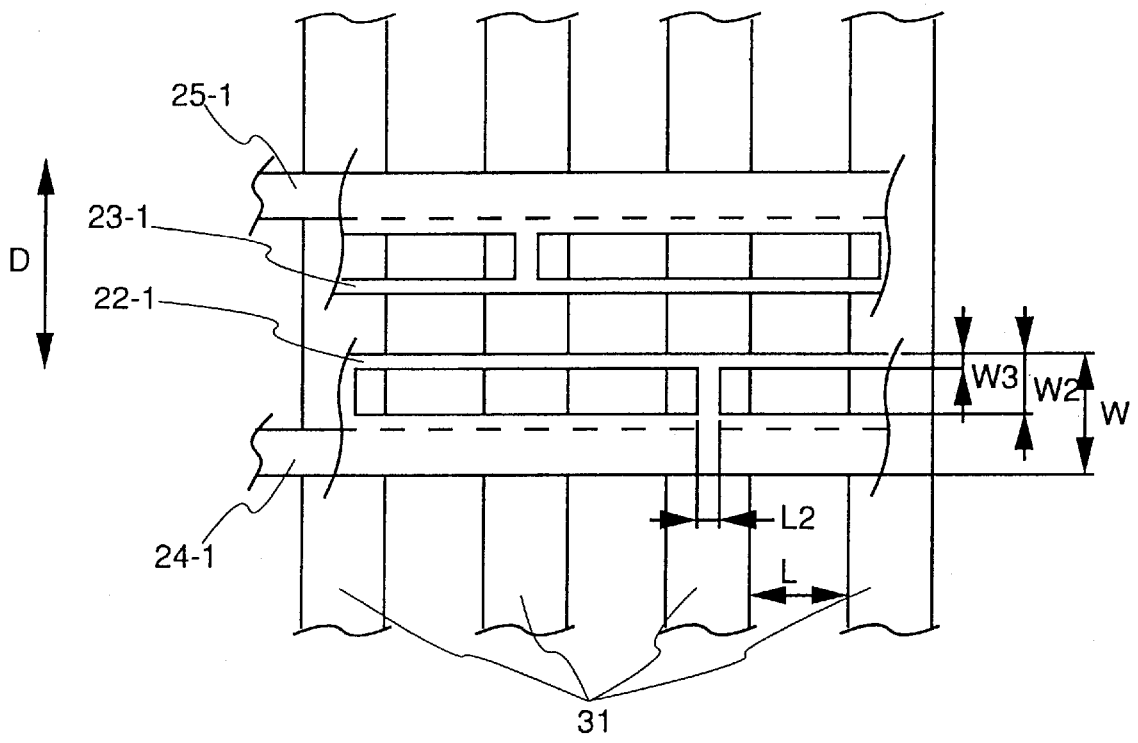
FIG. 13 is a top view, seen from the display screen side, showing the structure of a PDP according to a fourth embodiment of the present invention.

FIG. 13 is a top view, seen in the same direction as that shown in FIG. 1, showing the structure of a PDP according to a fourth embodiment of the present invention. This embodiment is characterized in that each of the pair of electrodes for sustaining discharge (X-electrode 22-1 and Y-electrode 23-1) is separated into a primary part and a secondary part over each discharge space, and electrode portions each having a thickness L2 and connecting the primary part to the secondary part are provided over separation walls 31 of alternate cells, and that the electrode portions provided for the X-electrode 22-1 are offset from those provided for the Y-electrode 23-1 by a phase corresponding to one cell.

In the embodiment shown in FIG. 11, the electrode portions, each of which has the thickness L2 and connects the primary part and secondary part separated from the electrode for sustaining discharge over the discharge space, are provided on the separation walls 31 of all of the cells. The connecting portion is provided to make the potential of the primary part conform to that of the secondary part containing the bus electrode. Accordingly, the connecting portions may be provided over the separation walls 31 of cells separated from each other at intervals of several cells; however, if the connecting portions are provided at intervals of an excessively large number of cells, then the voltage effect at the band-like electrode portion of the primary part becomes significant. As a result, the connecting portions may be desired to be provided at intervals of several ten cells or less. In the embodiment shown in FIG. 13, the connection portions are provided over separation walls 31 of alternate cells under the above consideration.

As described above, if the accuracy of positioning between the front glass base plate and the rear glass base plate of the PDP is low, then the above connecting portion may be partially offset from the separation wall 31 and partially located over the discharge space. In this case, the electrode area per unit width of the primary part is slightly increased, to reduce the degree of increasing the efficiency of luminescence. Assuming that the positioning between the front glass base plate and the rear glass base plate is deviated by a specific distance, the increase in electrode area of the primary part for each discharge cell in the PDP shown in FIG. 13 becomes half that in the PDP shown in FIG. 11. As a result, in the embodiment shown in FIG. 13, there is obtained an effect of increasing a margin in positioning between the front glass base plate and the rear glass base plate.

Embodiment 5

Figure 14:
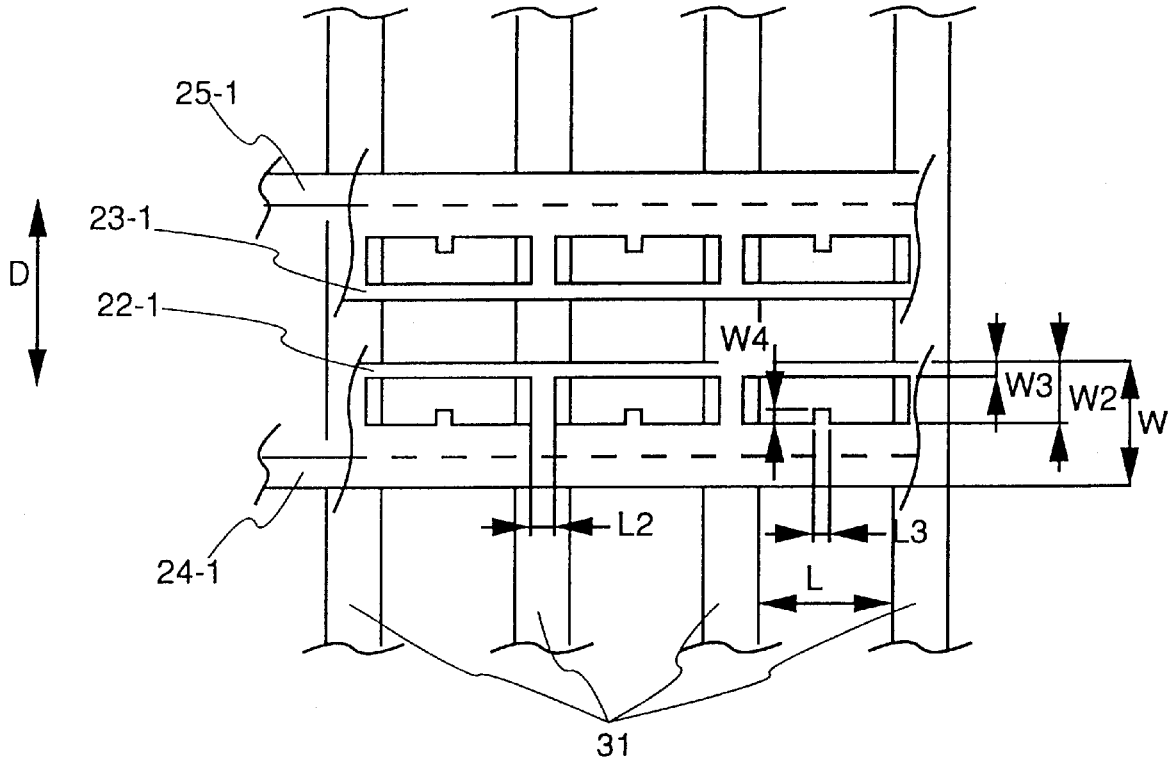
FIG. 14 is a top view, seen from the display screen side, showing the structure of a PDP according to a fifth embodiment of the present invention.

FIG. 14 is a top view, seen in the same direction as that shown in FIG. 1, showing the structure of a PDP according to a fifth embodiment of the present invention. This embodiment is characterized in that in each of the pair of electrodes for sustaining discharge, that is, the X-electrode 22-1 and Y-electrode 23-1, the primary part is cut off for each discharge cell into a perforated shape with a narrow area remaining on the discharge gap side. The PDP is a VGA panel of 42 inches in diagonal length, in which the width W of each electrode for sustaining discharge is 200 μm, the length L of the discharge space between the separation walls 31 is 400 μm, and the discharge gap is 60 μm. Here, the cutoff depth W2 of the electrode for sustaining discharge is 90 μm and the width W3 of the band-like electrode remaining on the discharge gap side is 10 μm. The band-like electrode portion, positioned on the discharge gap, of the electrode for sustaining discharge is connected to the secondary part of the electrode for sustaining discharge over the separation wall 31 being irrelevant to discharge. The thickness L2 of the connecting portion is 20 μm. This embodiment is further characterized in that a projecting electrode is provided on the secondary part of the electrode for sustaining discharge for each discharge cell in such a manner as to project toward the discharge gap side therefrom. The thickness L3 of the projecting electrode is 10 μm and the width W4 thereof of 20 μm. As a result, the electrode area per unit width of the primary part becomes about one-fifth of that of the secondary part. However, as described in the first embodiment, the apparent electrode area, effective to electrons and ions, of the primary part is not reduced to about one-fifth of that of the secondary part because the electric field is broadened via the dielectric substance. The discharge current during discharge between the pair of electrodes for sustaining discharge of this PDP is reduced to about one-fifth of that in the prior art PDP, in the front half of the discharge period of time. As a result, in this embodiment, there is obtained an effect of improving the efficiency of luminescence throughout discharge by about 70%.

Figure 15:
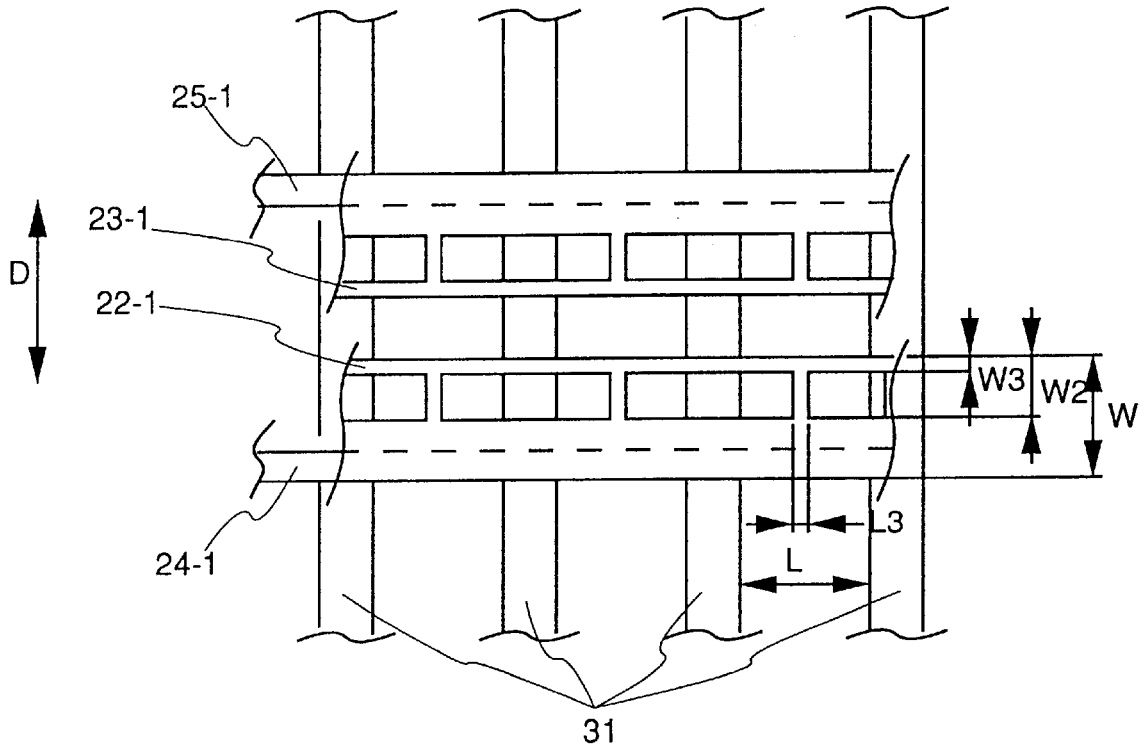
FIG. 15 is a top view, seen from the display screen side, showing another structure of the PDP according to the fifth embodiment of the present invention.

Here, the role of the projecting electrode extending from the secondary part of the electrode for sustaining discharge will be described below. In the case where the width (=W2−W3) of a hole perforated in the electrode for sustaining discharge is broadened, the projecting electrode assists migration of discharge generated on the discharge gap side of the electrode for sustaining discharge to the secondary part. If the width (=W2−W3) of a hole perforated in the electrode for sustaining discharge is excessively broadened, then the width W4 of the projecting electrode may be extended to be perfectly connected to the band-like electrode portion, on the discharge gap side, of the primary part. When the secondary part is connected to the primary part by means of the projecting electrode as described above, the electrode portion for connecting the primary part to the secondary part over the separation wall 31 may be omitted as shown in FIG. 15.

Embodiment 6

Figure 16:
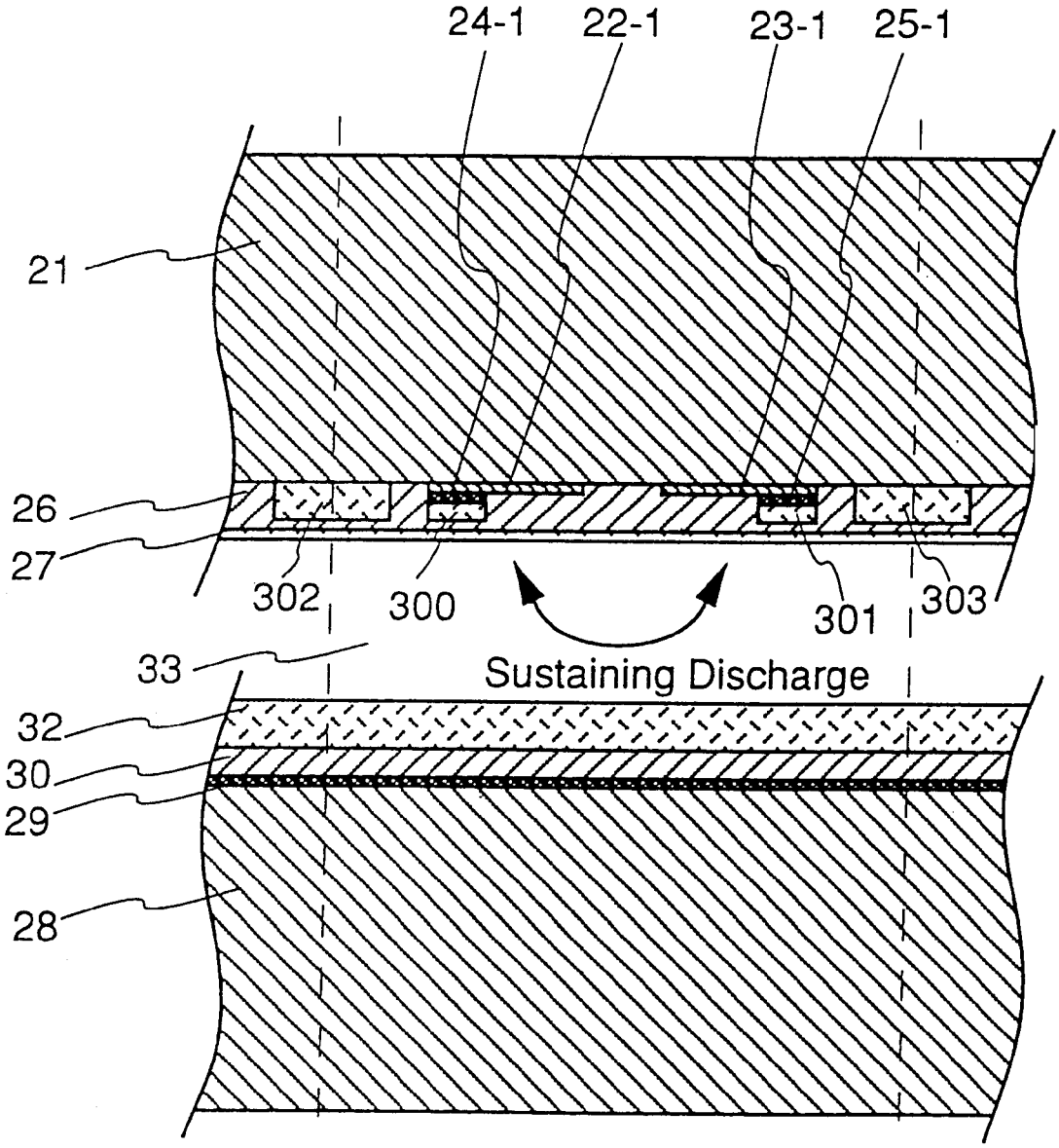
FIG. 16 is a sectional view, seen in the same direction as that shown by the arrow D2 in FIG. 2, showing the structure of a PDP according to a sixth embodiment of the present invention.

FIG. 16 is a sectional view, seen in the direction shown by the arrow D2 in FIG. 2, showing the structure of a PDP according to a sixth embodiment of the present invention. This embodiment is characterized in that the dielectric constant of the dielectric substance covering the electrode for sustaining discharge is partially changed for varying the capacitance of the electrode for sustaining discharge. Referring to FIG. 16, sustaining discharge is mainly generated in the space 33 filled with a discharge gas between the lower portion of the electrode 1 for sustaining discharge which is composed of the X-electrode 22-1 and the X-bus electrode 24-1 and the lower portion of the electrode 2 for sustaining discharge which is composed of the Y-electrode 23-1 and the Y-bus electrode 25-1. Here, in the layer of the dielectric substance 26 made from glass, the dielectric substance 26 is replaced with ferroelectric substances 300 and 301 at positions under the X-bus electrode 24-1 and the Y-bus electrode 25-1, respectively. Each of the ferroelectric substances 300 and 301 is made from lead zirconate ($PbZrO_3$) having antiferromagnetism, which has a dielectric constant being about five times that of the glass material, used for the dielectric substance 26, having a relatively high dielectric constant. With this configuration, the capacitance of the secondary part of the electrode for sustaining discharge becomes about five times the usual capacitance of the secondary part. A glass material having a large dielectric constant or barium titanate (BaTiO3) having a further large dielectric constant may be used in place of lead zirconate. In addition, the primary part of each of the X-electrode 22-1 and Y-electrode 23-1 is processed like the first embodiment. As a result, in this embodiment, there are obtained effects of improving the efficiency of luminescence throughout discharge by about 90% and improving the luminescence by about three times.

Here, the ferroelectric substances 300 and 301 are opaque; however, since the bus electrode is also opaque, the provision of the ferroelectric substances 300 and 301 does not obstruct transmission of emissive visible light from the phosphor 32 to the front glass base plate 21. In addition, the ferroelectric substances 300 and 310 are etched together with the bus electrodes 24-1 and 254-1 respectively, and therefore, they are formed in self-alignment therewith.

This embodiment is further characterized in that the dielectric substance 26 is replaced with weakly-dielectric substances (each having a low dielectric constant) at boundaries between the discharge cells designated by the dotted lines in FIG. 16. The weakly-dielectric substance is composed of fused quartz ($SiO_2$) having a dielectric constant being as low as about one-third that of the dielectric substance 26. With this configuration, since the electric field leaked into the discharge space at the boundary between the discharge cells is reduced, it is possible to obtain an effect of reducing the crosstalk between the discharge cells.

While the dielectric constant of the dielectric substance is partially increased in this embodiment, the same effect can be obtained by partially decreasing the thickness of the dielectric substance. In this case, however, care should be taken to keep the withstand voltage of the dielectric substance and to keep the condition for addressing emissive cells between the A-electrode and the electrodes for sustaining discharge (X-electrode and Y-electrode).

Embodiment 7

Figure 17:
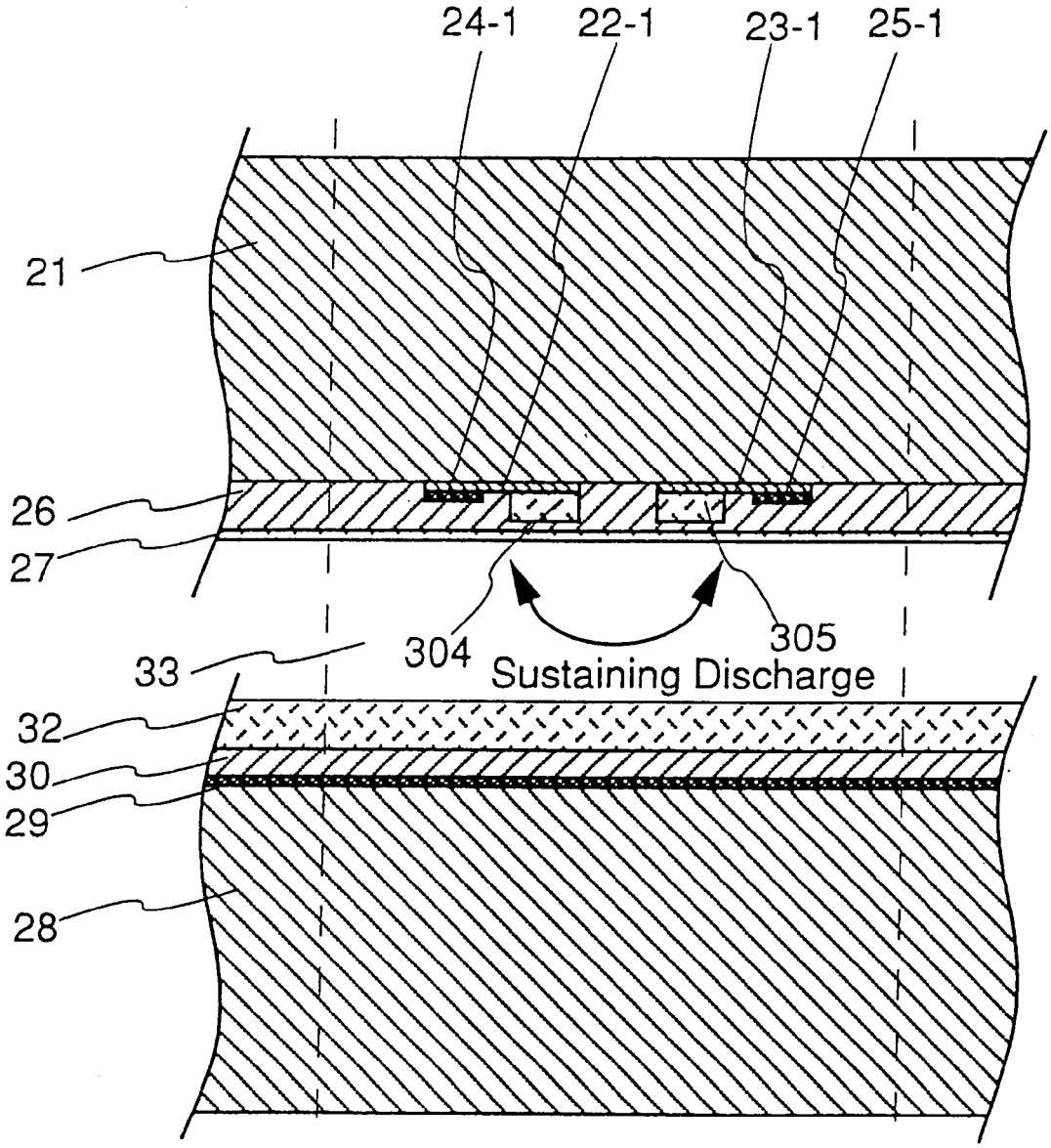
FIG. 17 is a sectional view, seen in the same direction as that shown in FIG. 16, showing the structure of a PDP according to a seventh embodiment of the present invention.

FIG. 17 is a sectional view, seen in the same direction as that shown in FIG. 16, showing the structure of a PDP according to a seventh embodiment of the present invention. This embodiment is characterized in that the dielectric constant of the dielectric substance covering the electrode for sustaining discharge is partially changed for varying the capacitance of the electrode for sustaining discharge. Referring to FIG. 17, sustaining discharge is mainly generated in the space 33 filled with a discharge gas between the lower portion of the electrode 1 for sustaining discharge which is composed of the X-15 electrode 22-1 and the X-bus electrode 24-1 and the lower portion of the electrode 2 for sustaining discharge which is composed of the Y-electrode 23-1 and the Y-bus electrode 25-1. Here, in the layer of the dielectric substance 26 made from glass, the dielectric substance 26 is replaced with weakly-dielectric substances (each having a low dielectric constant) 304 and 305. To be more specific, the weakly-dielectric substance 304 is positioned under a region, positioned on the discharge gap side and having one-half of the width of the electrode, of the X-electrode 22-1, that is positioned under a portion of the primary part of the X-electrode 22-1; and similarly the weakly-dielectric substance 305 is positioned under a portion of the primary part of the Y-electrode 23-1. Each of the weakly-dielectric substances 304 and 305 is composed of transparent fused quartz ($SiO_2$) which has a dielectric constant being as low as about one-third that of the dielectric substance 26. With this configuration, the capacitance of the primary part of the electrode for sustaining discharge is reduced to about one-third of the usual capacitance of the primary part, and correspondingly, the discharge current is reduced. In this embodiment, there is obtained an effect of improving the efficiency of luminescence throughout discharge by about 20%.

While the dielectric constant of the dielectric substance is partially lowered in this embodiment, the same effect can be obtained by partially increasing the thickness of the dielectric substance.

Although the concrete structures are described in the sixth and seventh embodiments, it should be noted that the basic feature of the present invention lies in that the dielectric constant of the dielectric substance 26 shown in FIG. 2 is changed at specific locations.

Embodiment 8

Figure 18:
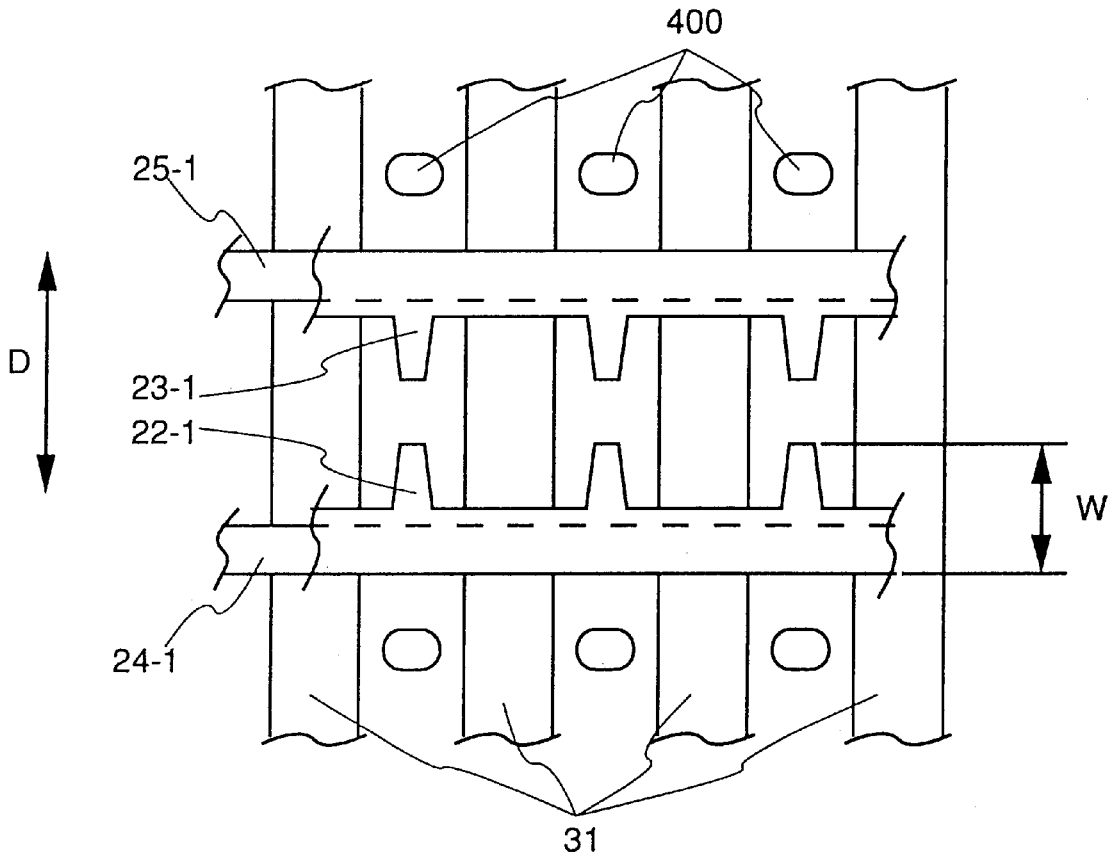
FIG. 18 is a top view, seen from the display screen side, showing the structure of a PDP according to an eighth embodiment of the present invention.

FIG. 18 is a top view, seen in the same direction as that shown in FIG. 1, showing a PDP according to an eighth embodiment of the present invention. The PDP in this embodiment is substantially similar in structure and size to the PDP shown in FIG. 1, but is different therefrom in that the PDP in this embodiment is provided with a partial separation wall 400 between the adjacent ones of the discharge cells. The provision of the separation wall 400 is effective to reduce crosstalk (abnormal discharge due to permeation of electrons and ions) with the adjacent discharge cell (not shown) sharing the separation walls 31, and hence to slightly extend the width W of the electrode for sustaining discharge and improve the luminescence. The separation walls 400 are formed together with the separation walls 31 in the same process. The width W of the electrode for sustaining discharge is 140 $\mu$m, which is 30 $\mu$m longer than that shown in FIG. 1. The projecting shape of the electrode for sustaining discharge is made long in proportional to the extension of the width W of the electrode for sustaining discharge. With this configuration, the capacitance of the primary part is set at a value being approximately one-fourth that of the secondary part. As a result, in this embodiment, as compared with the first embodiment shown in FIG. 1, the efficiency of luminescence is improved by 10% and the luminescence is also improved by 30%.

While the separation 400 is partially, independently formed in this embodiment, it is not necessarily formed independently but may be connected to the separation wall 31. In this case, however, the separation wall must be provided with a gap allowing gas to flow between the adjacent cells.

In the above-described embodiments, the shape and material of each of the pair of electrodes for sustaining discharge are changed for giving a specific distribution of the capacitance thereof; however, an effect of improving the efficiency of luminescence can be obtained by changing the shape and material of only one of the pair of electrodes for sustaining discharge, although the effect is slightly lower than that obtained by changing the shape and material of each of the pair of electrodes for sustaining discharge. While the present invention is applied to the AC surface-discharge PDP having the three-electrode structure in the above-described embodiments, the effect of the present invention to improve the efficiency of luminescence can be obtained in the case where the present invention is applied to an AC surface-discharge PDP having a two-electrode structure including pairs of electrodes for sustaining discharge.

According to the present invention, it is possible to improve the efficiency of luminescence of a PDP and hence to reduce the power consumption of the PDP.

What is claimed is:

1. In a plasma display system having a plasma display panel comprising a pair of base plates for forming a plurality of discharge cells therebetween, and a plurality of pairs of electrodes for sustaining discharge to form plasma through a dielectric substance thereon in said plurality of discharge cells, said plurality of pairs of electrodes for sustaining discharge being disposed on a same one of said pair of base plates, an improvement wherein said plasma display panel is configured such that a discharge current integrated over 40% of a discharge time Td from a start of said discharge time Td is smaller than a discharge current integrated over a remainder of said discharge time Td in one discharge, said discharge time Td being defined as a time interval over which a discharge current does not drop to less than 5% of its maximum value in one discharge.

2. In a plasma display system having a plasma display panel comprising a pair of base plates for forming a plurality of discharge cells therebetween, and a plurality of pairs of electrodes for sustaining discharge to form plasma through a dielectric substance thereon in said plurality of discharge cells, said plurality of pairs of electrodes for sustaining discharge being disposed on a same one of said pair of base plates, an improvement wherein said plasma display panel is configured such that a discharge current and an efficiency of luminescence become maximum, respectively, after 40% of a discharge time Td from a start of said discharge time Td, said discharge time Td being defined as a time interval over which a discharge current does not drop to less than 5% of its maximum value in one discharge.

3. In a plasma display system having a plasma display panel comprising a pair of base plates for forming a plurality of discharge cells therebetween, and a plurality of pairs of electrodes for sustaining discharge to form plasma through a dielectric substance thereon in said plurality of discharge cells, said plurality of pairs of electrodes for sustaining discharge being disposed on a same one of said pair of base plates, an improvement wherein, in each of said pair of electrodes for sustaining discharge, a portion which extends from an end of said electrode on a discharge gap side thereof in a direction where said electrode is opposed to the other one of said pair of electrodes and which has a length equivalent to two-thirds of the width of said electrode is taken as a primary part and the remaining portion is taken as a secondary part, a portion of at least one of said pair of electrodes, positioned in each discharge cell, is specified such that a ratio of an area of said primary part to an area of said secondary part is smaller than 1.4 and a side surface of said secondary part extending in a direction perpendicular to said direction in which said pair of electrodes are opposed to each other is at a discharge cell boundary side of said electrode between said discharge cells.

4. A plasma display system according to claim 3, wherein said ratio of the area of said primary part to the area of said secondary part is smaller than 1.

5. In a plasma display system having a plasma display panel in which pairs of electrodes for sustaining discharge to form plasma through a dielectric substance in a plurality of discharge cells each of which at least has a separation wall in one direction are provided on a same base plate, an improvement wherein, in each of said pair of electrodes for sustaining discharge, a portion which extends from an end of said electrode on a discharge gap side thereof in a direction where said electrode is opposed to the other one of said pair of electrodes and which has a length equivalent to two-thirds of the width of said electrode is taken as a primary part and the remaining portion is taken as a secondary part, a portion of at least one of said pair of electrodes, positioned in each discharge cell, is specified such that a ratio of an area of said primary part to an area of said secondary part is smaller than 1.4 and a side surface of said secondary part in a direction perpendicular to the direction in which said pair of electrodes are opposed to each other is at a separation wall side of said electrode.

6. A plasma display system according to claim 5, wherein said ratio of the area of said primary part to the area of said secondary part is smaller than 1.

7. A plasma display system according to claim 5, wherein a partial separation wall is provided between adjacent ones of said discharge cells in the direction where said pair of electrodes for sustaining discharge are opposed to each other.

8. A plasma display system according to claim 5, wherein the width of said electrode for sustaining discharge is in a range of 50 to 300 $\mu$m.

9. A plasma display system according to claim 5, wherein said primary part has at least one or more of projections for each discharge cell.

10. A plasma display system according to claim 9, wherein a side surface of a portion of said primary part extending from a boundary with said secondary part in each discharge cell is close to the boundary or said separation wall of said discharge cell; and the total of widths of said portion of said primary part and said secondary part in the direction where said pair of electrodes for sustaining discharge are opposed to each other is in a range of one-third or two-thirds of the width of said electrode for sustaining discharge.

11. A plasma display system according to claim 5, wherein a side surface of a portion of said primary part extending from the boundary with said secondary part to each discharge cell is at the discharge cell boundary side or said discharge cell separation wall side of said electrode;

at least a portion of said secondary part has a stacked structure of a transparent electrode and an opaque electrode; and the remaining portion, other than said stacked structure, of said electrode for sustaining discharge, is formed of a transparent electrode.

12. A plasma display system according to claim 5, wherein said primary part is perforated for each discharge cell.

13. In a plasma display system having a plasma display panel in which pairs of electrodes for sustaining discharge to form plasma through a dielectric substance in a plurality of discharge cells are provided on a same base plate, an improvement wherein, in each of said pair of electrodes for sustaining discharge, a portion which extends from an end of said electrode on a discharge gap side thereof in a direction where said electrode is opposed to the other one of said pair of electrodes and which has a length equivalent to two-thirds of the width of said electrode is taken as a primary part and the remaining portion is taken as a secondary part, a portion of at least one of said pair of electrodes, positioned in each discharge cell, is specified such that a ratio of a first capacitance between said primary part and a first dielectric substance opposed to said primary part in a discharge space of said discharge cell to a second capacitance between said secondary part and a second dielectric substance opposed to said secondary part in the discharge space of said discharge cell is smaller than 1.4.

14. A plasma display system according to claim 13, wherein said ratio of said first capacitance to said second capacitance is smaller than 1.

15. In a plasma display system having a plasma display panel in which pairs of electrodes for sustaining discharge to form plasma through a dielectric substance in a plurality of discharge cells each of which at least has a separation wall in one direction are provided on a same base plate, an improvement wherein, in each of said pair of electrodes for sustaining discharge, a portion which extends from an end of said electrode on a discharge gap side thereof in a direction where said electrode is opposed to the other one of said pair of electrodes and which has a length equivalent to two-thirds of the width of said electrode is taken as a primary part and the remaining portion is taken as a secondary part, a portion of at least one of said pair of electrodes, positioned in each discharge cell, is specified such that a ratio of a first capacitance between said primary part and a first dielectric substance opposed to said primary part in a discharge space of said discharge cell to a second capacitance between said secondary part and a second dielectric substance opposed to said secondary part in the discharge space of said discharge cell is smaller than 1.4.

16. A plasma display system according to claim 15, wherein said ratio of said first capacitance to said second capacitance is smaller than 1.

17. A plasma display system according to claim 15, wherein a partial separation wall is provided between adjacent ones of said discharge cells in a direction where said pair of electrodes for sustaining discharge are opposed to each other.

18. A plasma display system according to claim 15, an average dielectric constant of said first dielectric substance for storing said first capacitance in cooperation of said primary part is smaller than an average dielectric constant of said second dielectric substance for storing said second capacitance in cooperation of said secondary part.

19. A plasma display system according to claim 15, wherein a side surface of a portion of said primary part extending from the boundary with said secondary part in each discharge cell is at the discharge cell boundary side or said discharge cell separation wall side of said electrode;

at least a portion of said secondary part has a stacked structure of a transparent electrode and an opaque electrode;

the remaining portion, other than said stacked structure, of said electrode for sustaining discharge, is formed of a transparent electrode; and an average dielectric constant of a third dielectric substance opposed to said stacked structure portion in a discharge space of said discharge cell is larger than the average dielectric constant of said first dielectric substance for storing said first capacitance in cooperation of said primary part.

20. A plasma display system according to claim 15, wherein the width of said electrode for sustaining discharge is in a range of 50 to 300 $\mu$m.

* * * * *